US011387589B2

(12) United States Patent
Shimizu et al.

(10) Patent No.: US 11,387,589 B2
(45) Date of Patent: Jul. 12, 2022

(54) TERMINAL

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Toru Shimizu, Mie (JP); Shingo Kobayashi, Mie (JP); Sunghyun Byun, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/973,975

(22) PCT Filed: Jan. 21, 2019

(86) PCT No.: PCT/JP2019/001624
§ 371 (c)(1),
(2) Date: Dec. 10, 2020

(87) PCT Pub. No.: WO2020/003566
PCT Pub. Date: Jan. 2, 2020

(65) Prior Publication Data

US 2021/0257768 A1 Aug. 19, 2021

(30) Foreign Application Priority Data

Jun. 25, 2018 (JP) ..... JP2018-119823
Sep. 12, 2018 (JP) ..... JP2018-170432

(51) Int. Cl.
*H01R 13/44* (2006.01)
*H01R 13/04* (2006.01)

(52) U.S. Cl.
CPC ..... *H01R 13/44* (2013.01); *H01R 13/04* (2013.01)

(58) Field of Classification Search
CPC ..... H01R 13/44; H01R 13/04; H01R 43/16
See application file for complete search history.

(56) References Cited

U.S. PATENT DOCUMENTS 2,537,370 A 1/1951 Parnes
7,695,318 B1 * 4/2010 Wang ..... H01R 24/60 439/660

(Continued)

FOREIGN PATENT DOCUMENTS

GB 2090077 A 6/1982
JP H07-045329 A 2/1995
JP 2014-179290 A 9/2014

OTHER PUBLICATIONS

International Search Report dated Mar. 5, 2019 for WO 2020/003566 A1 (6 pages).

*Primary Examiner* — Truc T Nguyen
(74) *Attorney, Agent, or Firm* — Venjuris, P.C.

(57) ABSTRACT

A plate terminal 10 disclosed by this specification is provided with a plate-like body portion 12 made of metal and long in a front-rear direction, and a plate-like mounting portion 16 connected to the body portion 12 and projecting forward from a front end surface 14 of the body portion 12, a separate insulating member 18 being mounted on the mounting portion 16. The insulating member 18 is located forward of the front end surface 14 of the body portion 12

(Continued)

and covers at least parts of a front end surface 28 of the mounting portion 16 and the front end surface 14 of the body portion 12.

15 Claims, 26 Drawing Sheets

(56) References Cited

U.S. PATENT DOCUMENTS

| | | | | |
|---|---|---|---|---|
| 9,647,372 | B2 | 5/2017 | Eckel | |
| 10,541,490 | B2 * | 1/2020 | Reedy | H01R 24/66 |
| 10,855,018 | B2 * | 12/2020 | Duenkel | H01M 50/543 |
| 2002/0064986 | A1 | 5/2002 | Hirai et al. | |
| 2012/0009828 | A1 | 1/2012 | Yagi et al. | |
| 2013/0090012 | A1 | 4/2013 | Natter et al. | |
| 2013/0178109 | A1 * | 7/2013 | Ng | H01R 12/724 439/629 |
| 2018/0358732 | A1 * | 12/2018 | Yamanashi | H01R 13/035 |
| 2021/0254028 | A1 * | 8/2021 | Kobayashi | C12N 9/00 |

* cited by examiner

TERMINAL

CROSS REFERENCE TO RELATED APPLICATIONS

This application is a national phase of PCT application No. PCT/JP2019/001624, filed on 21 Jan. 2019, which claims priority from Japanese patent application Nos. 2018-119823 and 2018-170432 filed on 25 Jun. 2018 and 12 Sep. 2018, respectively, all of which are incorporated herein by reference.

TECHNICAL FIELD

A technique disclosed by this specification relates to a terminal.

BACKGROUND

A pin contact element described in Japanese National Publication of International Patent Application No. 2016-522550 (Patent Document 1 below) is known as an example of a conventional terminal. The pin contact element is shaped into a flat contact and includes a contact member and a contact protection member formed integrally to the contact member. The contact protection member covers an upper part and both side edges of the contact member, and a contact surface of the contact member is exposed to outside.

The pin contact element is provided in a connector element, which is provided with a housing molded integrally to the contact protection member. The housing is provided with a contact protection collar to surround the pin contact element, and an upper part of the contact protection collar is open. Further, a clearance between the contact protection collar and the pin contact element is such a clearance that a test finger cannot enter, thereby suppressing direct contact of the test finger with the contact surface of the contact member.

PRIOR ART DOCUMENT

Patent Document

Patent Document 1: JP 2016-522550A

SUMMARY OF THE INVENTION

Problems to be Solved

Since the contact protection member is molded integrally to the housing, the both side edges of the contact member are covered by the contact protection member, thereby causing a problem of enlarging a width of the pin contact element.

Means to Solve the Problem

A terminal disclosed in this specification is provided with a plate-like body portion made of metal and long in a front-rear direction, and a mounting portion connected to the body portion, a separate insulating member being mounted on the mounting portion, wherein the mounting portion is plate-like and projects forward from a front end surface of the body portion, and the insulating member is located forward of the front end surface of the body portion and covers at least parts of a front end surface of the mounting portion and the front end surface of the body portion.

Since the insulating member covers at least the parts of the front end surface of the mounting portion and the front end surface of the body portion, finger touch on metal parts (mounting portion and body portion) of the terminal from the front of the terminal is suppressed. Further, since the insulating member is separate from the housing into which the terminal is mounted, the insulating member needs not be extended to a resin portion of the housing via the body portion unlike a configuration in which an insulating member and a housing are integrally molded as before. Thus, a width of the terminal can be suppressed.

Further, the mounting portion may have a first inclined surface on a front end part of the mounting portion to thin a plate thickness toward the front end surface of the mounting portion, and the insulating member may include a first groove portion behind the insulating member to cover at least a part of the first inclined surface.

The first groove portion of the insulating member covers at least the part of the first inclined surface of the mounting portion, whereby an inner surface of the first groove portion contacts the first inclined surface when the insulating member is displaced in a thickness direction of the terminal. Thus, a displacement of the insulating member in the thickness direction of the terminal can be suppressed.

Further, the first groove portion may cover the entire first inclined surface in a width direction of the mounting portion.

The first groove portion covers the entire first inclined surface in the width direction of the mounting portion, whereby a displacement of the insulating member in the thickness direction of the terminal can be further suppressed as compared to a configuration in which the first groove portion covers a part of the first inclined surface in the width direction.

Further, out of both side end parts in the width direction of a plate surface of the mounting portion, the side end part on one side may have a second inclined surface thinning the plate thickness toward a side surface on the one side of the mounting portion and the side end part on another side may have a third inclined surface thinning the plate thickness toward a side surface on the other side of the mounting portion, and the insulating member may include a second groove portion configured to cover at least a part of the second inclined surface and a third groove portion configured to cover at least a part of the third inclined surface.

The second groove portion of the insulating member covers at least the part of the second inclined surface of the mounting portion and the third groove portion of the insulating member covers at least the part of the third inclined surface of the mounting portion, whereby an inner surface of the second groove portion contacts the second inclined surface and an inner surface of the third groove portion contacts the third inclined surface when the insulating member is displaced in the thickness direction of the terminal. Thus, a displacement of the insulating member in the thickness direction of the terminal can be suppressed.

Further, the second groove portion may cover the entire second inclined surface of the mounting portion in the front-rear direction, and the third groove portion may cover the entire third inclined surface of the mounting portion in the front-rear direction.

The second groove portion covers the entire second inclined surface in the front-rear direction, and the third groove portion covers the entire third inclined surface in the front-rear direction, whereby a displacement of the insulating member in the thickness direction of the terminal can be further suppressed as compared to a configuration in which the second groove portion covers a part of the second inclined surface in the front-rear direction and the third groove portion covers a part of the third inclined surface in the front-rear direction.

Further, a length in the width direction of the mounting portion may be set shorter than a length in the width direction of the body portion, the front end surface of the body portion may be composed of a first front end surface located on one widthwise side and a second front end surface located on another widthwise side across the mounting portion, the insulating member may be composed of a first insulating member to be mounted on the mounting portion from a side surface on the one side and a second insulating member to be mounted on the mounting portion from a side surface on the other side, out of both side surfaces in the width direction of the mounting portion, and the first and second insulating members may be joined to each other, the first insulating member may be shaped to be long in the front-rear direction, be located forward of the first front end surface of the body portion and cover at least a part of the first front end surface of the body portion, and the second insulating member may include a first covering portion shaped to be long in the front-rear direction, located forward of the second front end surface of the body portion and configured to cover at least a part of the second front end surface of the body portion and a second covering portion shaped to be long in the front-rear direction, located forward of the front end surface of the mounting portion and configured to cover the front end surface of the mounting portion.

For example, by mounting the first insulating member on the mounting portion from the side surface on the one side of the mounting portion, subsequently mounting the second insulating member on the mounting portion from the side surface on the other side of the mounting portion and further joining the first and second insulating members, the insulating member can be assembled with the mounting portion. Thus, quick assembly is possible as compared to a configuration in which an insulating member is formed on a mounting portion by insert molding (configuration in which metal parts of a terminal are set in a mold and resin is poured into the mold and cooled and solidified). Further, no dedicated mold is necessary, which contributes to a cost reduction.

Further, a sum of lengths in the width direction of the first and second insulating members mounted on the mounting portion is equal to or shorter than a length in the width direction of the body portion.

Since the sum of the lengths in the width direction of the first and second insulating members is equal to or shorter than the length in the width direction of the body portion, an overall width of the terminal can be suppressed.

Further, a first recess may be provided to be open in the side surface on the one side of the mounting portion, a first projection to be fit to the first recess may be provided to project on a surface of the first insulating member facing the side surface on the one side of the mounting portion and a displacement of the first insulating member in the front-rear direction may be restricted by fitting the first recess and the first projection, a second recess may be provided to be open in the side surface on the other side of the mounting portion, a second projection to be fit to the second recess may be provided to project on a surface of the first covering portion of the second insulating member facing the side surface on the other side of the mounting portion and a displacement of the second insulating member in the front-rear direction may be restricted by fitting the second recess and the second projection.

By fitting the first projection of the first insulating member to the first recess of the mounting portion and fitting the second projection of the second insulating member to the second recess of the mounting portion, the first projection of the first insulating member contacts an inner surface of the first recess of the mounting portion and the second projection of the second insulating member contacts an inner surface of the second recess of the mounting portion if the insulating member is going to be displaced in the front-rear direction. Thus, a displacement of the insulating member in the front-rear direction is restricted.

Further, the first insulating member and the second covering portion of the second insulating member may respectively have contact surfaces to be held in contact with each other, an opening may be provided in the contact surface of the first insulating member, a first projecting portion may be provided to project on the contact surface of the second covering portion of the second insulating member, and the first and second insulating members may be joined to each other by press-fitting the first projecting portion into the opening.

By press-fitting the first projecting portion of the first insulating member into the opening of the second insulating member, the first and second insulating members can be joined.

Further, a first inclined surface thinning the plate thickness toward the front end surface of the mounting portion may be provided on a front end part of the plate surface of the mounting portion, a first groove portion long in the width direction may be provided to be open in a rear surface of the second covering portion of the second insulating member, and an inner surface of the first groove portion may be in surface contact with the front end surface and the first inclined surface of the mounting portion.

Since the inner surface of the first groove portion is in surface contact of the front end surface and the first inclined surface of the mounting portion of the body portion, a displacement of the insulating member in the thickness direction of the terminal can be suppressed.

Further, a second inclined surface thinning the plate thickness toward the side surface on the one side of the mounting portion may be provided on a side end part on the one side, out of both side end parts in the width direction of the plate surface of the mounting portion, a second groove portion long in the front-rear direction may be provided to be open in a surface of the first insulating member facing the side surface on the one side of the mounting portion, an inner surface of the second groove portion may be in surface contact with the side surface on the one side of the mounting portion and the second inclined surface, a third inclined surface thinning the plate thickness toward the side surface on the other side of the mounting portion may be provided on the side end part on the other side, out of the both side end parts in the width direction of the plate surface of the mounting portion, a third groove portion long in the front-rear direction may be provided to be open in a surface of the first covering portion of the second insulating member facing the side surface on the other side of the mounting portion, and an inner surface of the third groove portion may be in surface contact with the side surface on the other side of the mounting portion and the third inclined surface.

Since the inner surface of the second groove portion of the first insulating member is in surface contact with the side surface on the one side of the mounting portion and the second inclined surface and the inner surface of the third groove portion of the first covering portion of the second insulating member is in surface contact with the side surface on the other side of the mounting portion and the third inclined surface, a displacement of the insulating member in the thickness direction of the terminal can be suppressed.

Further, a length in the width direction of the mounting portion may be set shorter than a length in the width direction of the body portion, the front end surface of the body portion may be composed of a first front end surface located on the one widthwise side and a second front end surface located on the other widthwise side across the mounting portion, the insulating member may be composed of a first insulating member shaped to be long in the front-rear direction, located forward of the first front end surface of the body portion and configured to cover at least a part of the first front end surface of the body portion, and a second insulating member integrally formed to the first insulating member, the second insulating member may include a first covering portion connected to the first insulating member, shaped to be long in the front-rear direction, located forward of the second front end surface of the body portion and configured to cover at least a part of the second front end surface of the body portion, and a second covering portion shaped to be long in the width direction, located forward of the front end surface of the mounting portion and configured to cover the front end surface of the mounting portion, the first insulating member may have a first facing surface facing a side surface on one side of the mounting portion and a first fitting portion may be provided on the first facing surface, the first covering portion of the second insulating member may have a second facing surface facing a side surface on another side of the mounting portion and a second fitting portion may be provided on the second facing surface, a third fitting portion to be fit to the second fitting portion may be provided on the side surface on the one side of the mounting portion, a fourth fitting portion to be fit to the second fitting portion may be provided on the side surface on the other side of the mounting portion, and a displacement of the insulating member in the front-rear direction may be restricted by fitting the first and third fitting portions and fitting the second and fourth fitting portions.

By fitting the first fitting portion of the first insulating member to the third fitting portion of the mounting portion and fitting the second fitting portion of the first covering portion of the second insulating member to the fourth fitting portion of the mounting portion, a displacement of the insulating member in the front-rear direction from the mounting portion is restricted and the detachment of the insulating member from the mounting portion is suppressed.

Further, the first fitting portion may serve as a first projection projecting toward the side surface on the one side of the mounting portion from the first facing surface, the second fitting portion may serve as a second projection projecting toward the side surface on the other side of the mounting portion from the second facing surface, the third fitting portion may serve as a first recess open in the side surface on the one side of the mounting portion and to be fit to the first projection, and the fourth fitting portion may serve as a fourth recess open in the side surface on the other side of the mounting portion and to be fit to the second projection.

By fitting the first projection of the first insulating member to the first recess of the mounting portion and fitting the second projection of the first covering portion of the second insulating member to the second recess of the mounting portion, a displacement of the insulating member in the front-rear direction from the mounting portion is restricted and the detachment of the insulating member from the mounting portion is suppressed.

Further, the first insulating member and the first covering portion of the second insulating member may be resiliently displaceable in the width direction.

Since the first insulating member and the first covering portion of the second insulating member are resiliently displaceable in the width direction, the first and second fitting portions of the insulating member can be displaced to the positions of the third and fourth fitting portions of the mounting portion by resiliently displacing the first insulating member and the first covering portion of the second insulating member in the width direction when the first and second fitting portions of the insulating member are fit to the third and fourth fitting portions of the mounting portion. Since the insulating member can be mounted on the mounting portion by being assembled in this way, easy mounting is possible as compared to the case where an insulating member is mounted on a mounting portion by insert molding.

Further, a first inclined surface thinning the plate thickness toward the front end surface of the mounting portion may be provided on the front end part of the plate surface of the mounting portion, a first groove portion long in the width direction may be provided to be open in a rear surface of the second covering portion, and an inner surface of the first groove portion may be in surface contact with the front end surface and the first inclined surface of the mounting portion.

Since the inner surface of the first groove portion is in surface contact with the front end surface and the first inclined surface of the mounting portion of the body portion, a displacement of the insulating member in the thickness direction of the terminal can be suppressed.

Further, the mounting portion may include a first mounting portion projecting forward from an end part on one side of the front end surface of the body portion and a second mounting portion projecting forward from an end part on another side of the front end surface of the body portion, the insulating member may include a second covering portion provided from the first mounting portion to the second mounting portion and configured to cover a front end surface of the first mounting portion, a front end surface of the second mounting portion and the front end surface of the body portion, and a second projecting portion projecting toward a gap between the first and second mounting portions from a rear surface of the second covering portion, a first fitting portion may be provided on one side surface and a second fitting portion may be provided on another side surface, out of both side surfaces in the width direction of the second projecting portion, a third fitting portion to be fit to the first fitting portion may be provided on a surface of the first mounting portion facing the one side surface of the second projecting portion, a fourth fitting portion to be fit to the second fitting portion may be provided on a surface of the second mounting portion facing the other side surface of the second projecting portion, and a displacement of the insulating member in the front-rear direction may be restricted by fitting the first fitting portion to the third fitting portion and fitting the second fitting portion to the fourth fitting portion.

By fitting the first fitting portion of the insulating member to the third fitting portion of the mounting portion and fitting the second fitting portion of the insulating member to the fourth fitting portion of the mounting portion, a displacement of the insulating member in the front-rear direction from the mounting portion is restricted and the detachment thereof from the mounting portion is suppressed.

Effect of the Invention

According to the terminal disclosed in this specification, it is possible to suppress a width of a plate-like terminal including an insulating member on a front end.

DETAILED DESCRIPTION TO EXECUTE THE INVENTION

First Embodiment

A plate terminal (terminal) 10 of a first embodiment is described with reference to FIGS. 1 to 11. In the following description, an upward direction of FIG. 6 (Z direction of FIG. 6) is referred to as a forward direction, which is a connecting direction of the plate terminal 10, a downward direction of FIG. 6 is referred to as a rearward direction, a rightward direction of FIG. 6 (Y direction of FIG. 6) is referred to as one width direction of the plate terminal 10, and a leftward direction of FIG. 6 is referred to as another width direction of the plate terminal 10. Further, a rightward direction of FIG. 3 (X direction of FIG. 3) is referred to as one thickness direction of the plate terminal 10, and a leftward direction of FIG. 3 is referred to as another thickness direction of the plate terminal 10.

Figure 1:
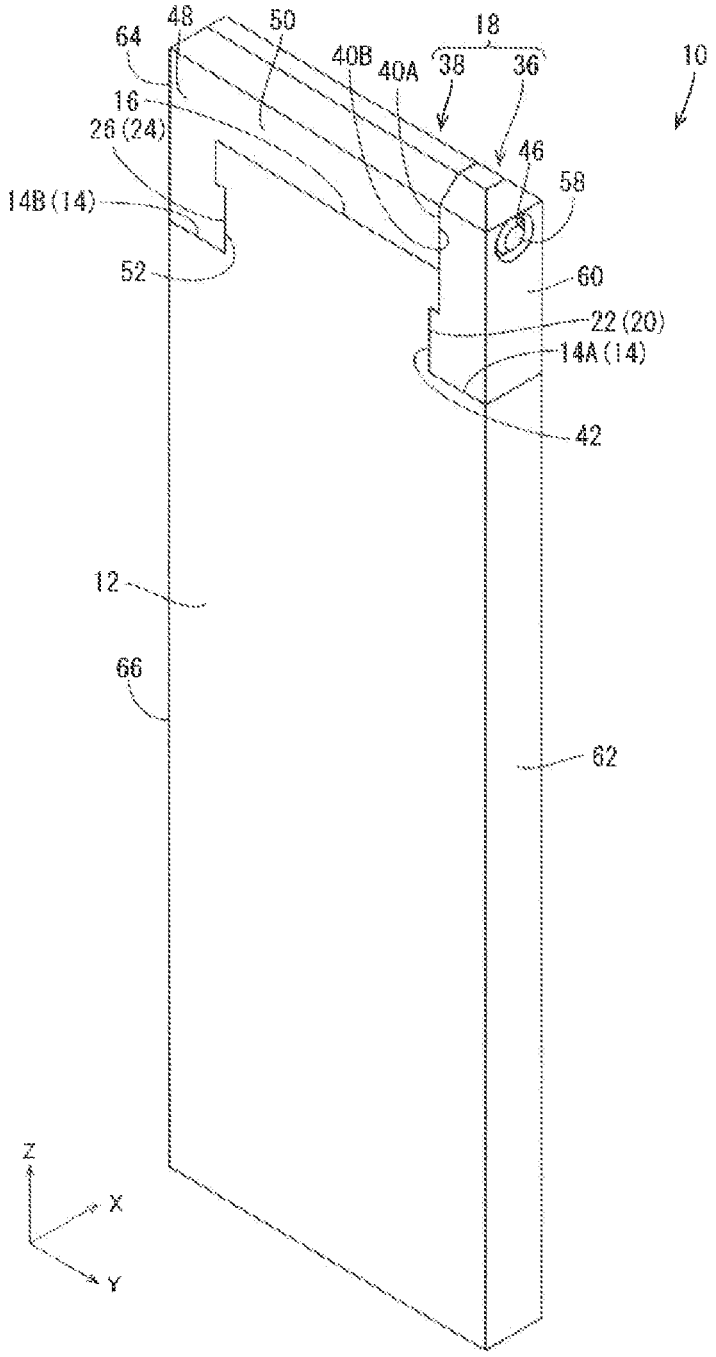
FIG. 1 is a perspective view of a terminal in a first embodiment.
Figure 2:
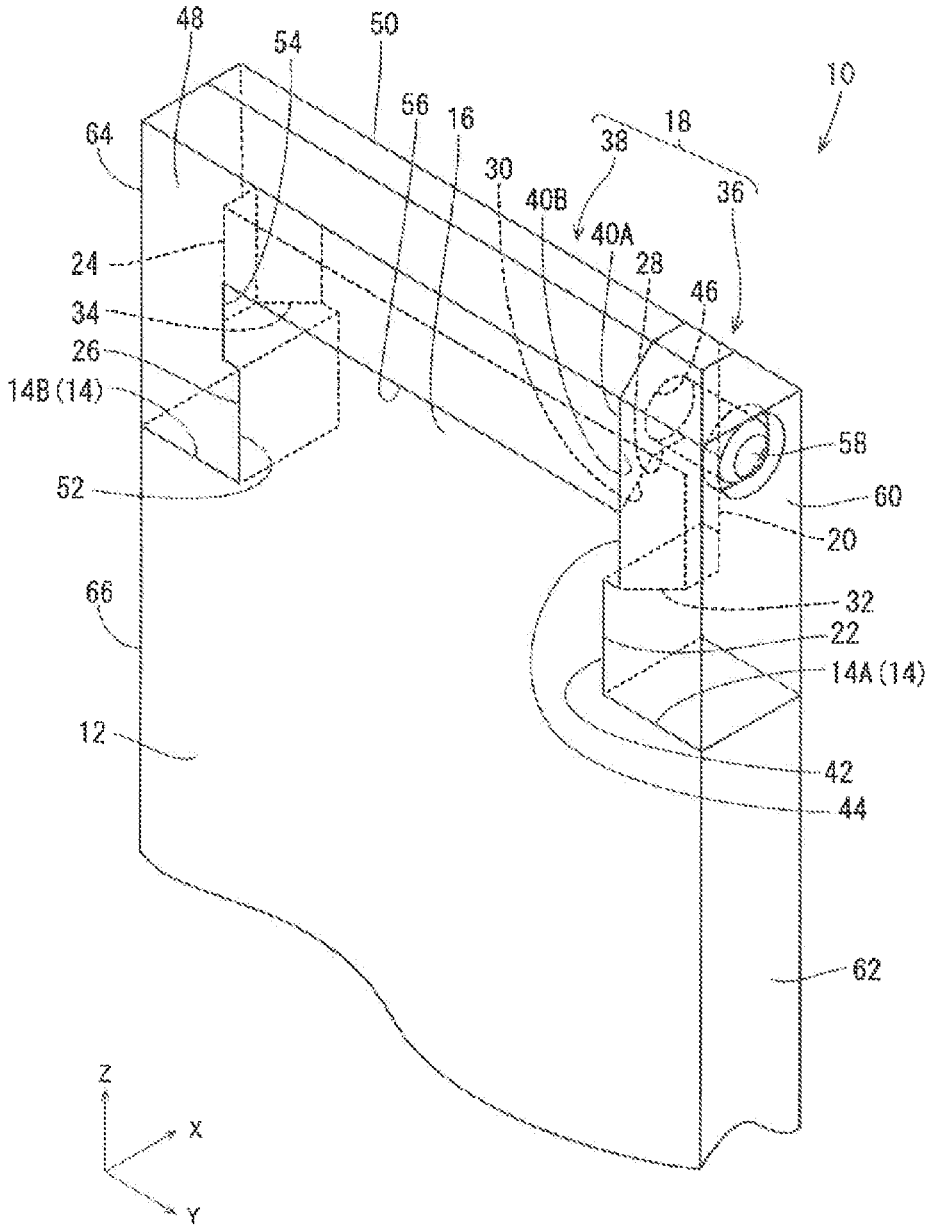
FIG. 2 is an enlarged view near a mounting portion of the terminal in FIG. 1.
Figure 3:
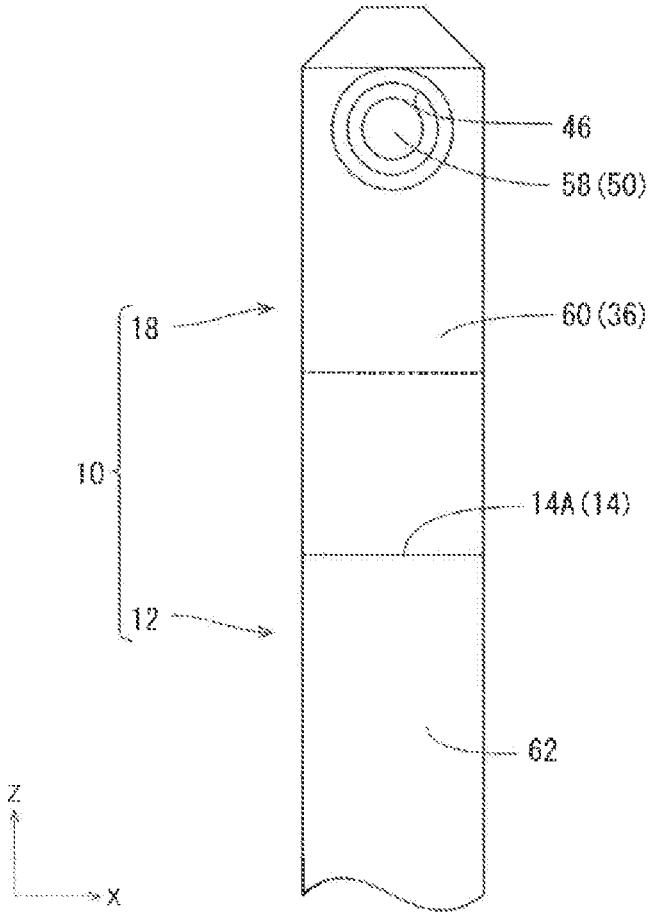
FIG. 3 is an enlarged view near the mounting portion of the terminal viewed from a width direction.

The plate terminal 10 is mounted in a housing (not shown) made of resin and, as shown in FIGS. 1 and 2, composed of a body portion 12 made of metal and in the form of a plate long in a front-rear direction, a plate-like mounting portion 16 connected to the body portion 12 and projecting forward from a front end surface 14 of the body portion 12, and a separate insulating member 18 to be mounted on the mounting portion 16. The insulating member 18 is located forward of the front end surface 14 of the body portion 12. Since the insulating member 18 is separate from the housing (not shown), into which the plate terminal 10 is mounted, as just described, the insulating member 18 needs not be extended to a resin portion of the housing via the body portion 12 as compared to a configuration in which an insulating member and a housing are integrally molded as before, wherefore a width of the body portion 12 can be suppressed.

Figure 5:
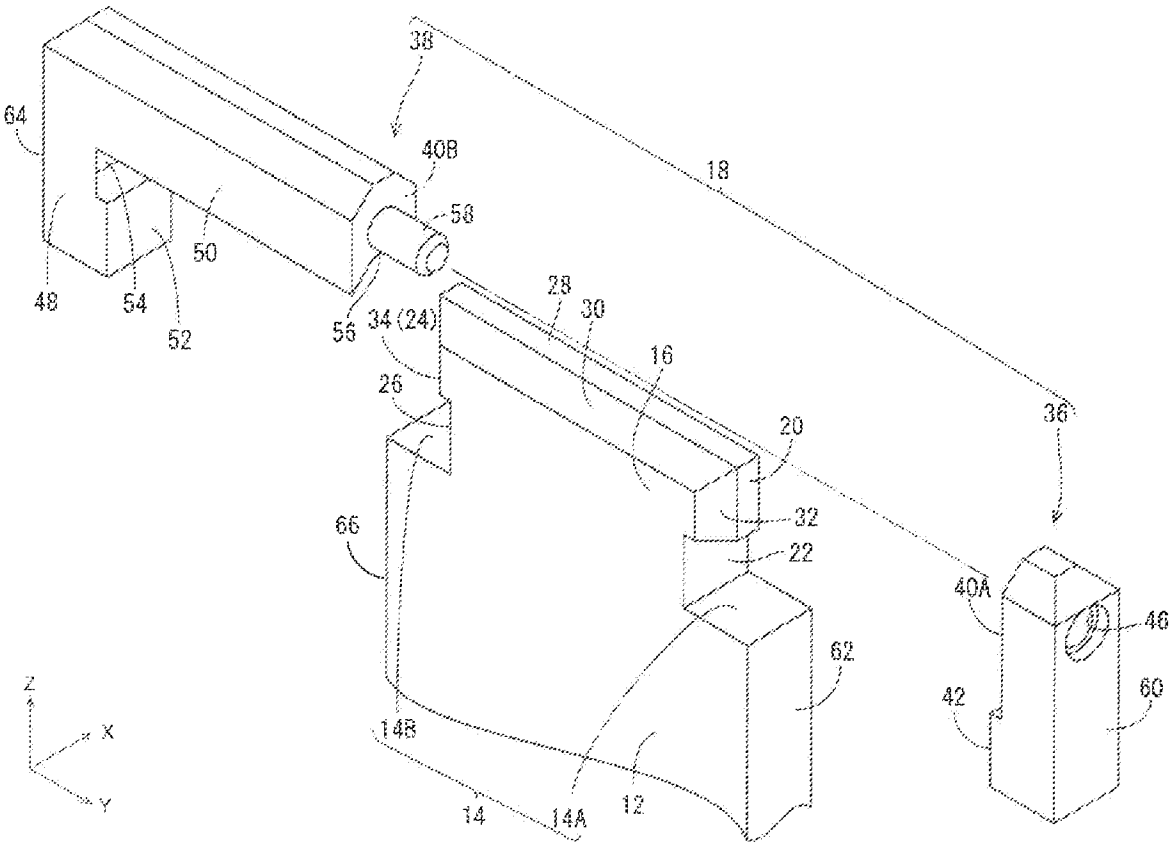
FIG. 5 is an exploded perspective view of the terminal.
Figure 6:
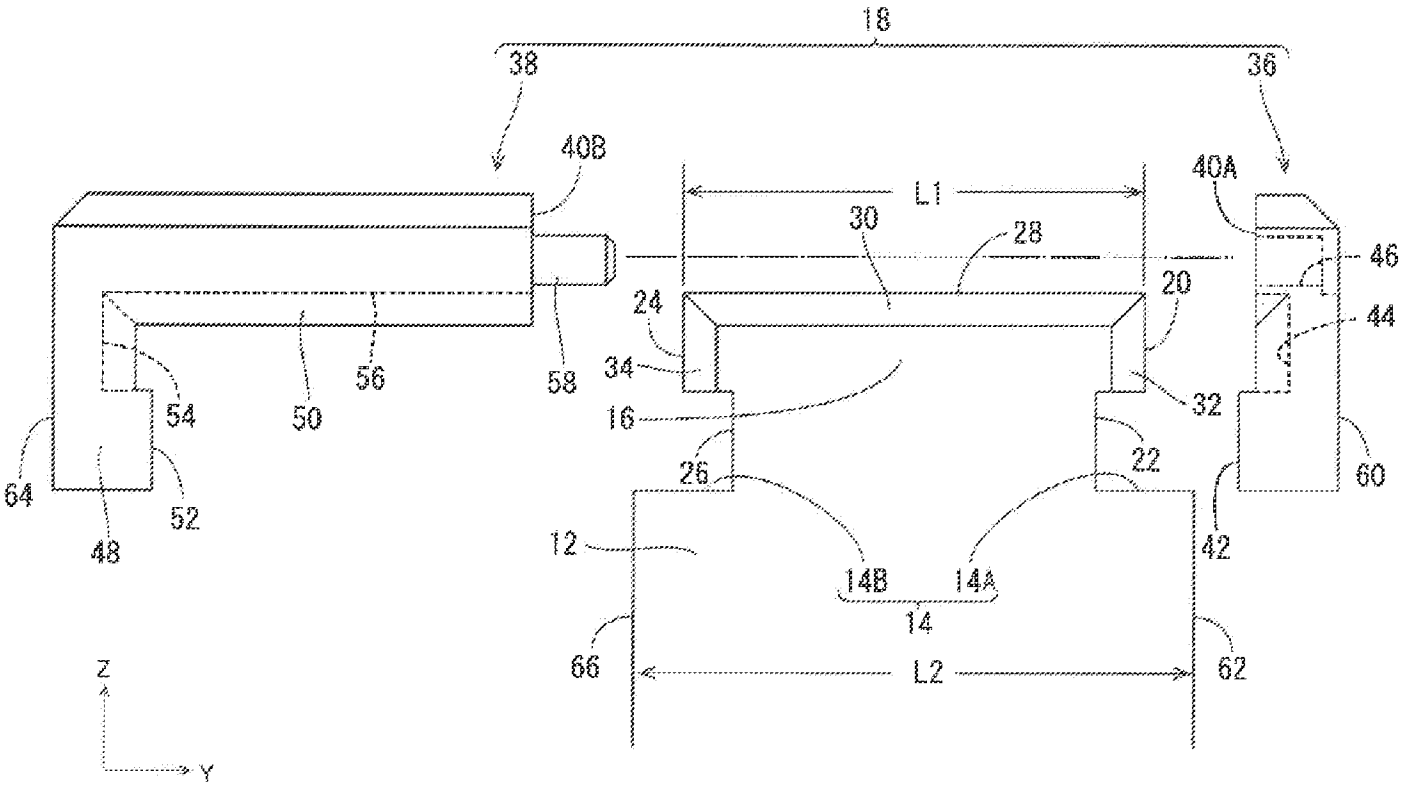
FIG. 6 is an exploded view of the terminal viewed from a thickness direction.

As shown in FIG. 5, the front end surface 14 of the body portion 12 is composed of a first front end surface 14A and a second front end surface 14B. As shown in FIG. 6, a length L1 in the width direction of the mounting portion 16 is set shorter than a length L2 in the width direction of the body portion 12, the first front end surface 14A is on one widthwise side of the mounting portion 16 and the second front end surface 14B is on another widthwise side of the mounting portion 16.

As shown in FIGS. 5 and 6, a first side surface 20, which is a side surface on the one widthwise side of the mounting portion 16, is provided with a groove-like first recess 22, and a second side surface 24, which is a side surface on the other widthwise side of the mounting portion 16, is provided with a groove-like second recess 26.

Figure 7:
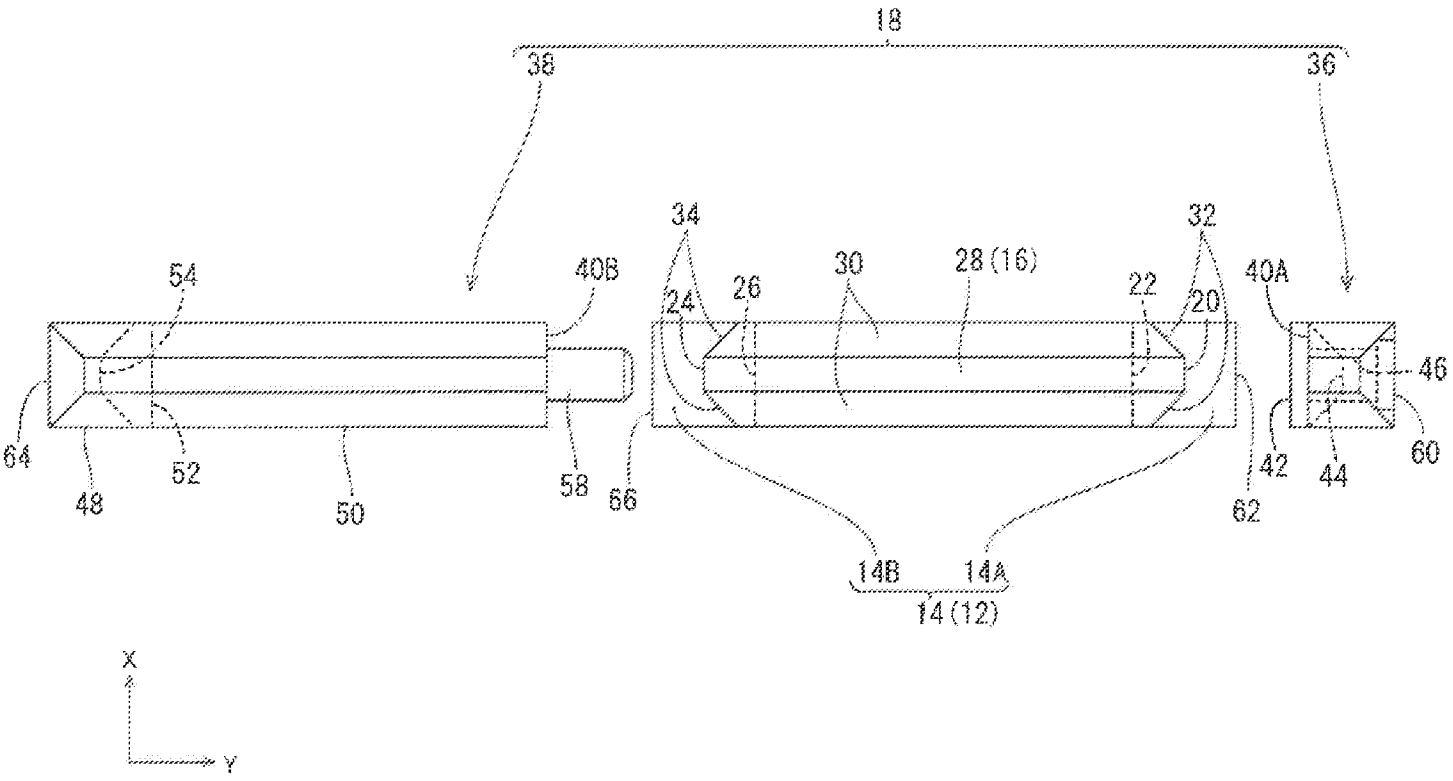
FIG. 7 is an exploded front view of the terminal.

As shown in FIGS. 5, 6 and 7, a first inclined surface 30 inclined toward a front end surface 28 of the mounting portion 16 is provided on a front end part of a plate surface of the mounting portion 16.

A second inclined surface 32 inclined toward the first front end surface 20 of the mounting portion 16 is provided on a side end part on the one widthwise side of the plate surface of the mounting portion 16.

A third inclined surface 34 inclined toward the second front end surface 24 of the mounting portion 16 is provided on a side end part on the other widthwise side of the plate surface of the mounting portion 16.

The insulating member 18 is made of resin and, as shown in FIG. 5, composed of a first insulating member 36 to be mounted on the mounting portion 16 from the side of the first side surface 20 of the mounting portion 16 and a second insulating member 38 to be mounted on the mounting portion 16 from the side of the second side surface 24 of the mounting portion 16. The first and second insulating members 36, 38 respectively include a contact surface 40A and a contact surface 40B to be held in contact with each other as shown in FIG. 2.

Figure 8:
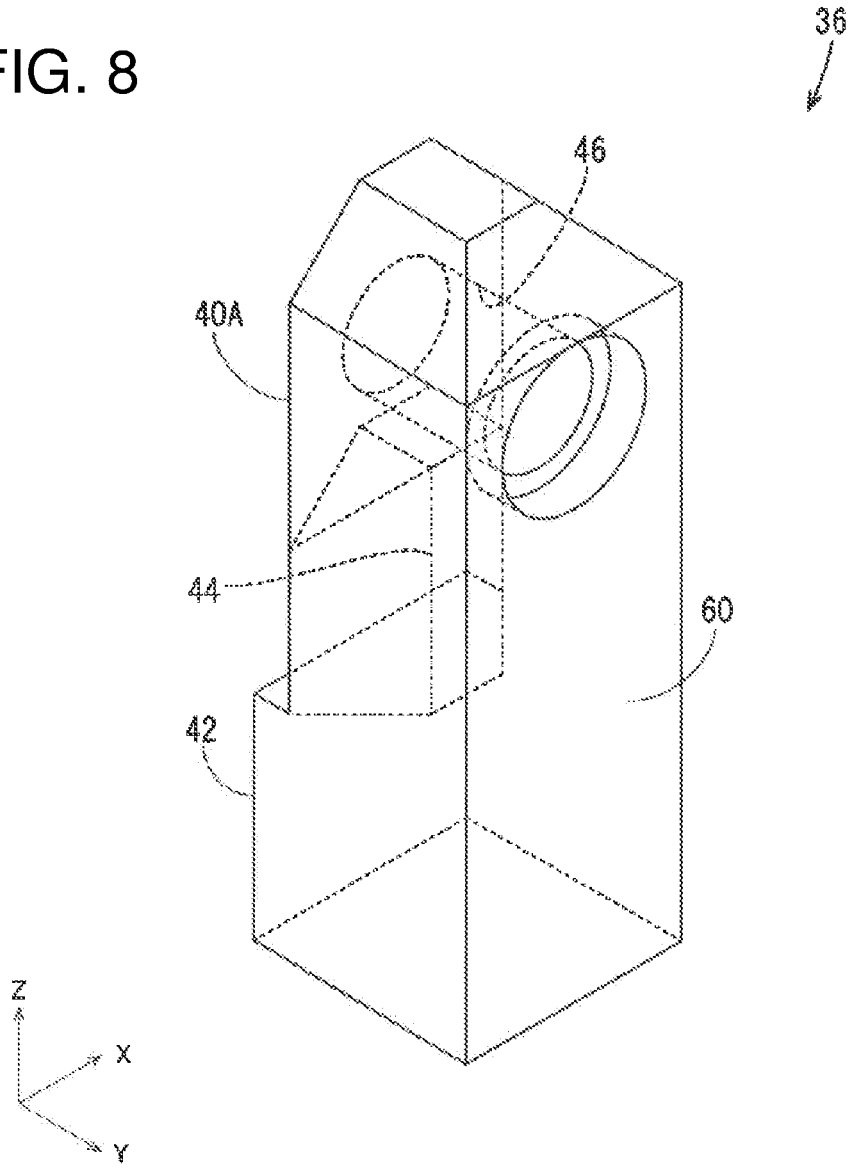
FIG. 8 is a perspective view of a first insulating member.
Figure 9:
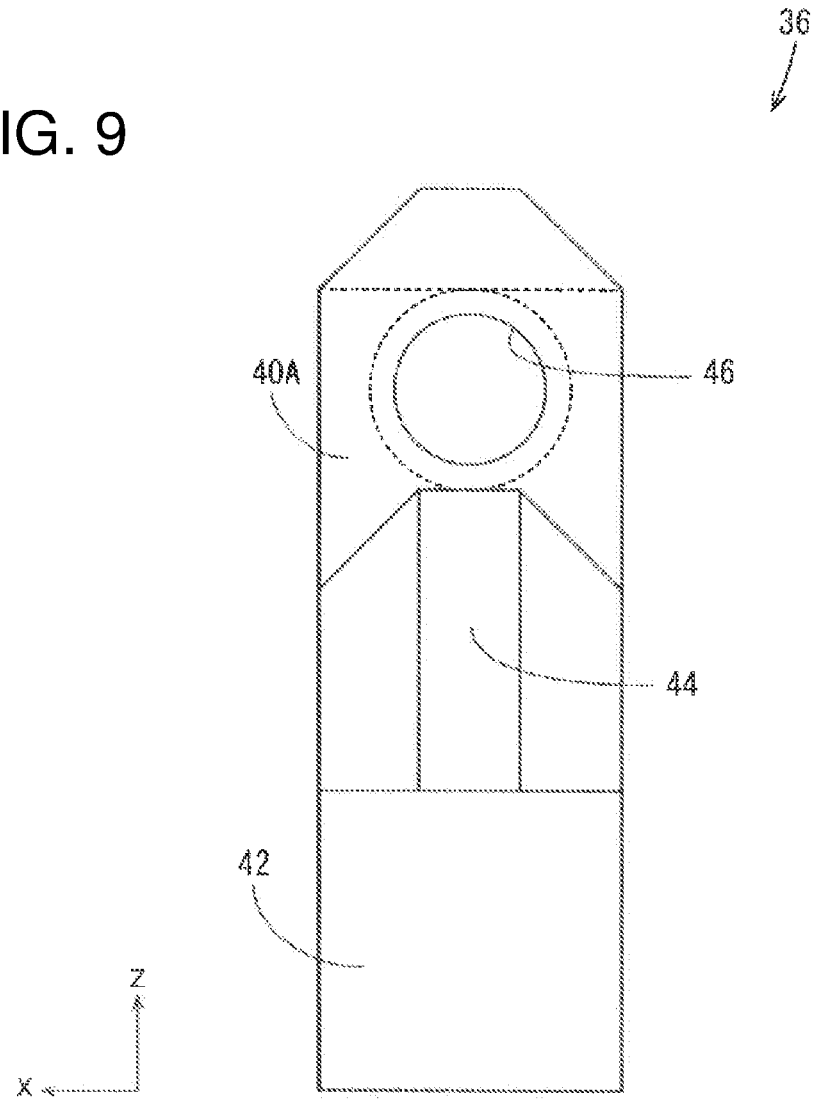
FIG. 9 is a view of the first insulating member viewed from the width direction.

As shown in FIGS. 8 and 9, the first insulating member 36 is shaped to be long in the front-rear direction, and a side surface of the first insulating member 36 on the other widthwise side (side surface facing the first front end surface 20 of the mounting portion 16) is provided with a first projection 42 and a second groove portion 44.

The first projection 42 is provided at a position corresponding to the first recess 22 of the mounting portion 16 as shown in FIG. 6, and the first projection 42 of the first insulating member 36 is fit to the first recess 22 of the mounting portion 16 as shown in FIG. 2. In this way, if the first insulating member 36 is going to be displaced in the front-rear direction, the first projection 42 comes into contact with an inner surface of the first recess 22. Thus, a displacement of the first insulating member 36 in the front-rear direction is restricted.

The second groove portion 44 is provided at a position corresponding to the second inclined surface 32 and the first side surface 20 of the mounting portion 16 as shown in FIG. 6, and covers the entire second inclined surface 32 and the entire first side surface 20 of the mounting portion 16 in the front-rear direction as shown in FIG. 2. Further, an inner surface of the second groove portion 44 is provided to face the second inclined surface 32 and the first side surface 20 of the mounting portion 16 and in surface contact with the entire mounting portion 16 in the front-rear direction. In this way, a displacement of the first insulating member 36 in a thickness direction is suppressed. Further, since the inner surface of the second groove portion is in surface contact with the entire second inclined surface 32 of the mounting portion 16 in the front-rear direction, a contact area of the second groove portion 44 and the mounting portion 16 is larger as compared to a configuration in which an inner surface of a second groove portion is in contact with a part of a second inclined surface of a mounting portion, and a displacement of the first insulating member 36 in the thickness direction can be further suppressed. Note that the second groove portion 44 may be configured to cover parts of the second inclined surface 32 and the first side surface 20 of the mounting portion 16 as long as finger touch on the mounting portion 16 can be suppressed. For example, the second groove portion 44 may be configured to cover parts of the second inclined surface 32 and the first side surface 20 in the front-rear direction or may be configured to cover parts of the second inclined surface 32 and the first side surface 20 in a direction intersecting the front-rear direction. Further, the inner surface of the second groove portion 44 may contact a part of the second inclined surface 32 of the mounting portion 16.

As shown in FIGS. 8 and 9, the contact surface 40A of the first insulating member 36 is provided on a side surface on the other widthwise side, and an opening 46 is open in the contact surface 40A.

Figure 10:
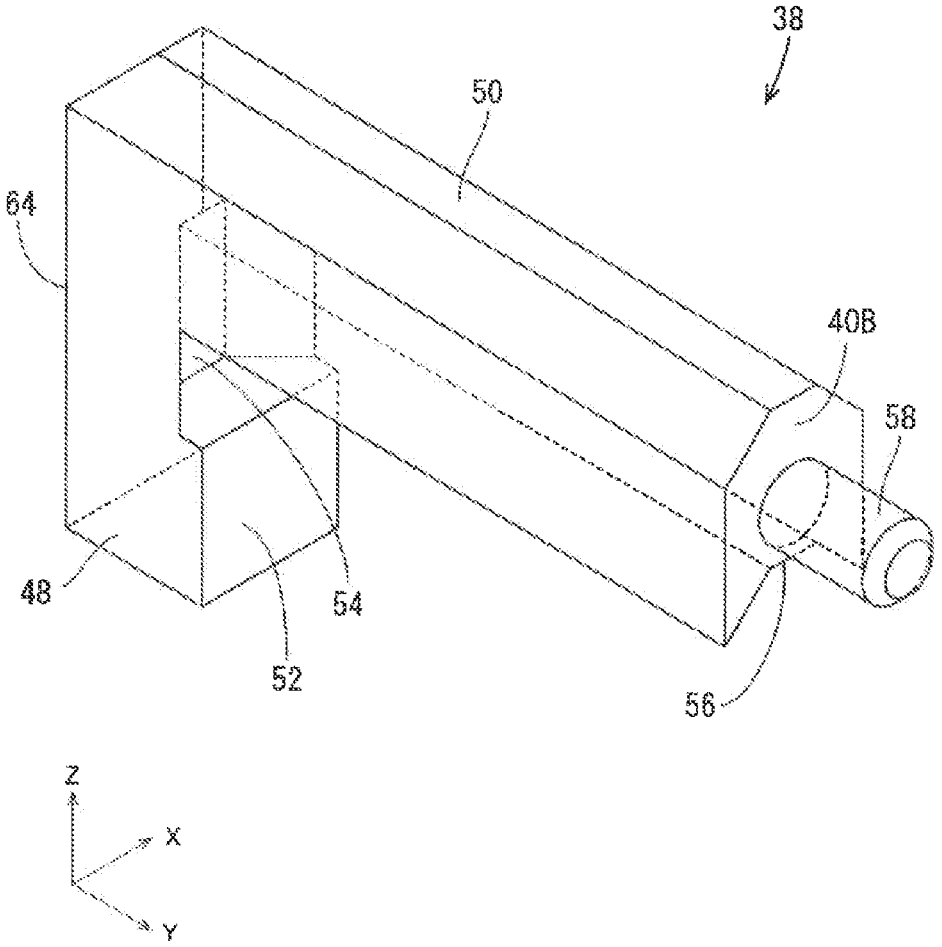
FIG. 10 is a perspective view of a second insulating member.
Figure 11:
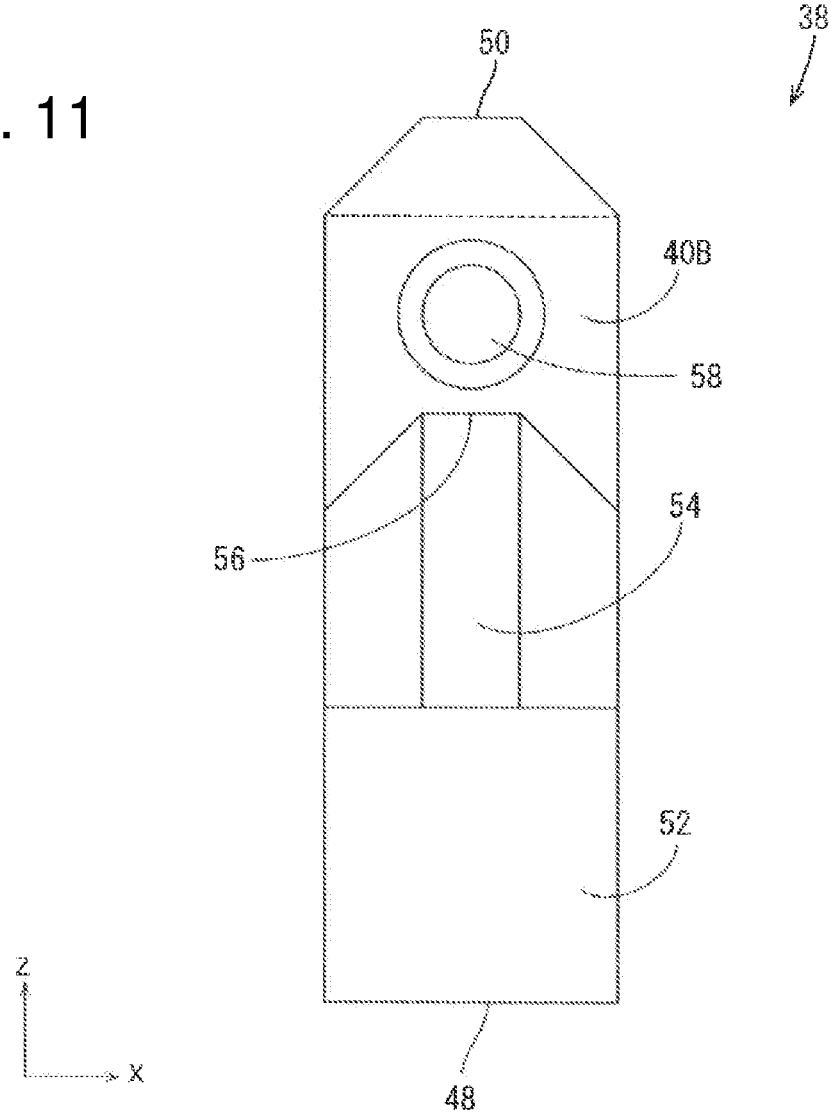
FIG. 11 is a view of the second insulating member viewed from the width direction.
Figure 12:
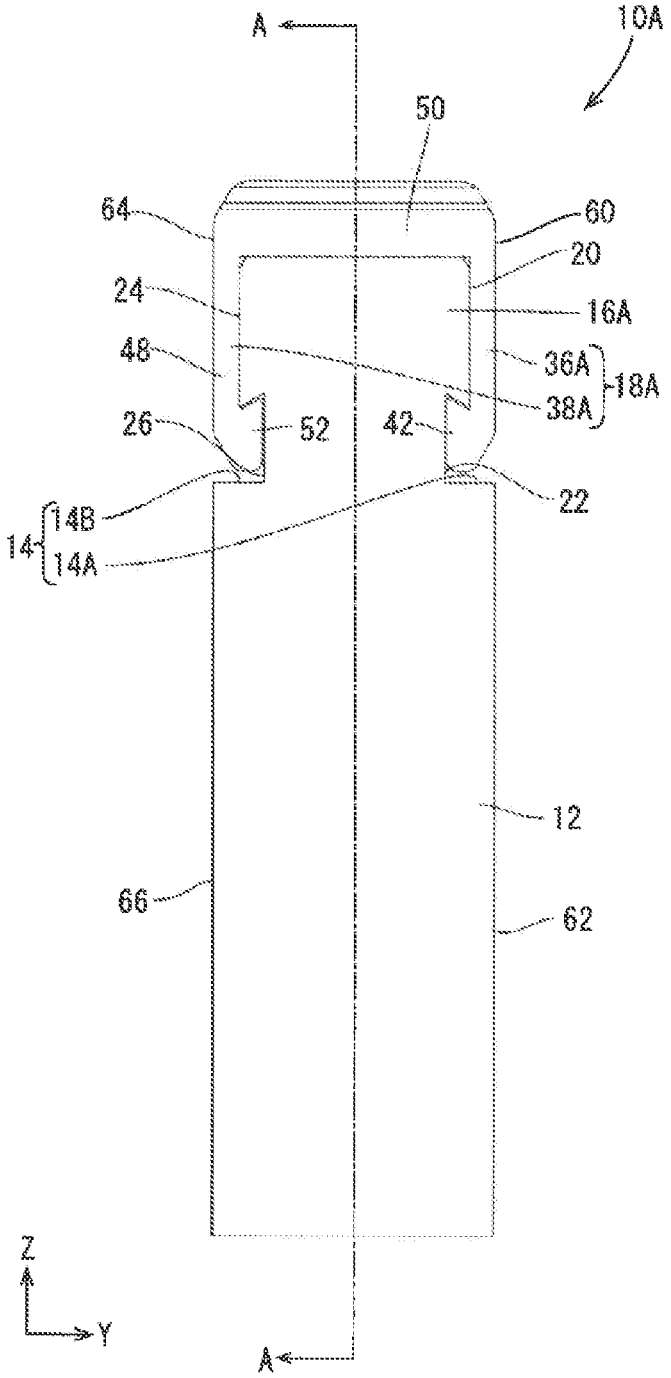
FIG. 12 is a front view of a terminal in a second embodiment.

As shown in FIGS. 10 and 11, the second insulating member 38 is composed of a first covering portion 48 shaped to be long in the front-rear direction and a second covering portion 50 shaped to be long in the width direction and projecting in the one width direction from the side surface of the first covering portion 48 on the one widthwise side.

As shown in FIG. 6, a side surface of the first covering portion 48 on the one widthwise side (side surface facing the second side surface 24 of the mounting portion 16) is provided with a second projection 52 and a third groove portion 54.

The second projection 52 of the first covering portion 48 is provided at a position corresponding to the second recess 26 of the mounting portion 16 as shown in FIG. 6, and the second projection 52 of the first covering portion 48 is fit to the second recess 26 of the mounting portion 16 as shown in FIG. 2. In this way, if the second insulating member 38 is going to be displaced in the front-rear direction, the second projection 52 comes into contact with an inner surface of the second recess 26. Thus, a displacement of the second insulating member 38 in the front-rear direction is restricted.

The third groove portion 54 of the first covering portion 48 is provided at a position corresponding to the third inclined surface 34 and the second side surface 24 of the mounting portion 16 as shown in FIG. 6, and covers the entire third inclined surface 34 and the entire second side surface 24 of the mounting portion 16 in the front-rear direction as shown in FIG. 2. Further, an inner surface of the third groove portion 54 is provided to face the third inclined surface 34 and the second side surface 24 of the mounting portion 16 and in surface contact with the entire mounting portion 16 in the front-rear direction. In this way, a displacement of the second insulating member 38 in the thickness direction is suppressed. Further, since the inner surface of the second groove portion 54 is in surface contact with the entire third inclined surface 34 of the mounting portion 16 in the front-rear direction, a contact area of the third groove portion 54 and the mounting portion 16 is larger as compared to a configuration in which an inner surface of a third groove portion is in contact with a part of a third inclined surface of a mounting portion, and a displacement of the second insulating member 38 in the thickness direction can be further suppressed. Note that the third groove portion 54 may be configured to cover parts of the third inclined surface 34 and the second side surface 24 of the mounting portion 16 as long as finger touch on the mounting portion 16 can be suppressed. For example, the third groove portion 54 may be configured to cover parts of the third inclined surface 34 and the second side surface 24 in the front-rear direction or may be configured to cover parts of the third inclined surface 34 and the second side surface 24 in a direction intersecting the front-rear direction. Further, the inner surface of the third groove portion 54 may contact a part of the third inclined surface 34 of the mounting portion 16.

As shown in FIGS. 10 and 11, a first groove portion 56 long in the width direction is provided to be open in a rear surface of the second covering portion 50. As shown in FIG. 2, the first groove portion 56 is provided at a position corresponding to the first inclined surface 30 of the mounting portion 16 and the front end surface 28 of the mounting portion 16, and covers the entire first inclined surface 30 and the entire front end surface 28 of the mounting portion 16 in the width direction of the mounting portion 16. Further, an inner surface of the first groove portion 56 is provided to face the first inclined surface 30 of the mounting portion 16 and the front end surface 28 of the mounting portion 16, and in surface contact with the entire mounting portion 16 in the width direction. In this way, a displacement of the second insulating member 38 in the thickness direction is suppressed. Further, since the inner surface of the first groove portion 56 is in surface contact with the entire first inclined surface 30 of the mounting portion 16 in the width direction, a contact area of the first groove portion 56 and the mounting portion 16 is larger as compared to a configuration in which an inner surface of a first groove portion is in contact with a part of a first inclined surface of a mounting portion, and a displacement of the first insulating member 36 in the thickness direction can be further suppressed. Note that the first groove portion 56 may be configured to cover parts of the first inclined surface 30 and the front end surface 28 of the mounting portion 16 as long as finger touch on the mounting portion 16 can be suppressed. For example, the first groove portion 56 may be configured to cover parts of the first inclined surface 30 and the front end surface 28 in the front-rear direction or may be configured to cover parts of the first inclined surface 30 and the front end surface 28 in a direction intersecting the front-rear direction. Further, the inner surface of the first groove portion 56 may contact a part of the first inclined surface 30 of the mounting portion 16.

As shown in FIGS. 10 and 11, the contact surface 40B of the second insulating member 38 is provided on a side surface of the second covering portion 50 on the one widthwise side, and a first projecting portion 58 projects on the contact surface 40B. As shown in FIG. 2, the first projecting portion 58 of the second insulating member 38 is press-fit into the opening 46 of the first insulating member 36 and the first and second insulating members 36, 38 are joined. Since the separate insulating member 18 is mounted by being assembled with the mounting portion 16 in this way, quick assembly is possible as compared to a configuration in which an insulating member is formed on a mounting portion by insert molding (configuration in which metal parts of the plate terminal 10 are set in a mold, resin is poured into the mold and cooled and solidified). Further, no dedicated mold is necessary, which can contribute to a cost reduction.

As shown in FIG. 2, a side surface 60 of the first insulating member 36 on the one widthwise side and a side surface 62 of the body portion 12 on the one widthwise side are flush with each other, and a side surface 64 of the second insulating member 38 on the other widthwise side and a side surface 66 of the body portion 12 on the other widthwise side are flush with each other. In this way, as shown in FIGS. 4 and 6, a sum L3 of lengths in the width direction of the first and second insulating members 36, 38 is equal to the length L2 in the width direction of the body portion 12 and an overall width of the plate terminal 10 can be suppressed.

Figure 4:
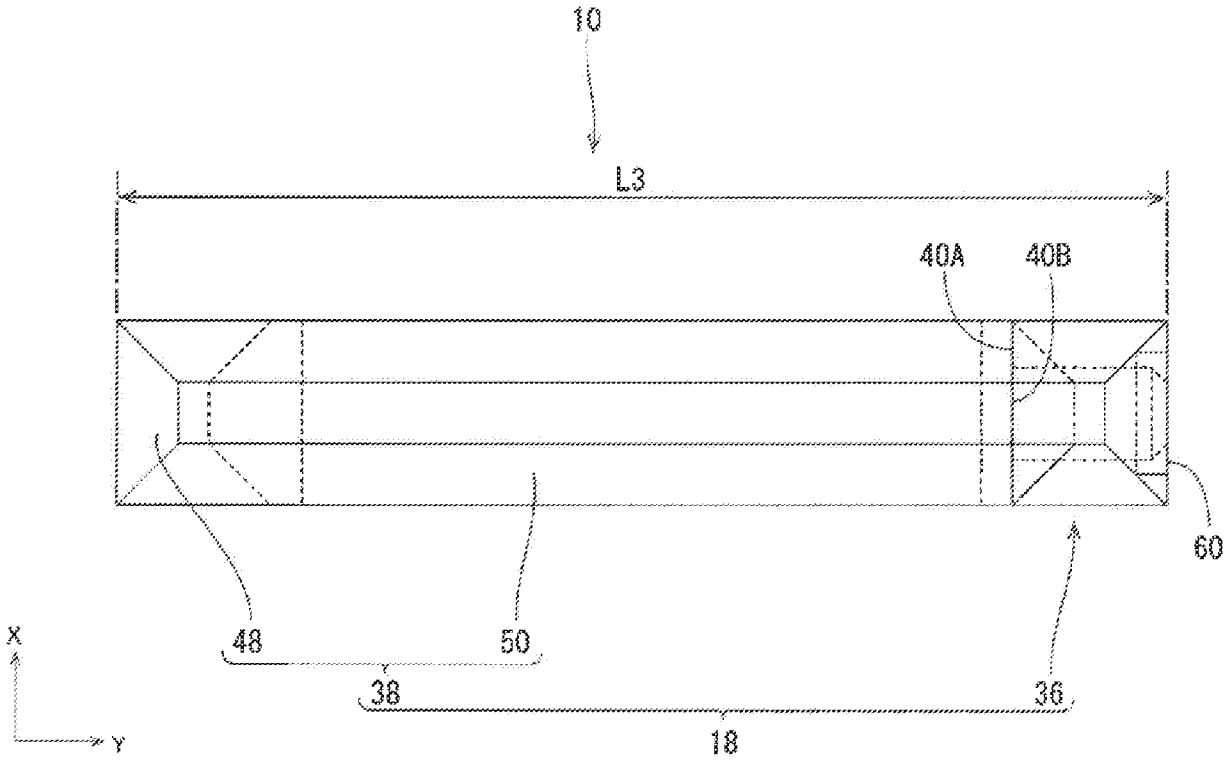
FIG. 4 is a front view of the terminal.

As shown in FIGS. 2 and 4, the first insulating member 36 covers the entire first front end surface 14A of the body portion 12 from front. Further, the first covering portion 48 of the second insulating member 38 covers the entire second front end surface 14 of the body portion 12 from front. Further, the second covering portion 50 of the second insulating member 38 covers the front end surface 28 of the mounting portion 16 from front. In this way, finger touch on metal parts (mounting portion 16 and body portion 12) of the plate terminal 10 from the front of the plate terminal 10 is suppressed.

As described above, according to this embodiment, since the insulating member 18 covers the parts of the front end surface 28 of the mounting portion 16 and the front end surface 14 of the body portion 12, finger touch on the metal parts (mounting portion 16 and body portion 12) of the plate terminal (terminal) 10 from the front of the plate terminal (terminal 10) is suppressed. Further, since the insulating member 18 is separate from the housing into which the plate terminal (terminal) 10 is mounted, the insulating member 18 needs not be extended to the resin portion of the housing via the body portion 12 unlike a configuration in which an insulating member and a housing are integrally molded as before. Therefore, the width of the plate terminal (terminal) 10 can be suppressed.

Further, the insulating member 18 can be assembled with the mounting portion 16, for example, by mounting the first insulating member 36 on the mounting portion 16 from the side of the first side surface (side surface on one side) 20 of the mounting portion 16, subsequently mounting the second insulating member 38 on the mounting portion 16 from the side of the second side surface (side surface on another side) 24 of the mounting portion 16 and further joining the first and second insulating members 36, 38. Thus, quick assembly is possible as compared to a configuration in which an insulating member is formed on a mounting portion by insert molding (configuration in which the metal parts of the plate terminal (terminal) 10 are set in a mold, resin is poured into the mold and cooled and solidified) as before. Further, no dedicated mold is necessary, which can contribute to a cost reduction.

Further, since the sum L3 of the lengths in the width direction of the first and second insulating members 36, 38 is equal to or less than the length L2 in the width direction of the body portion, the overall width of the plate terminal (terminal) 10 can be suppressed.

Further, by fitting the first projection 42 of the first insulating member 36 to the first recess 22 of the mounting portion 16 and fitting the second projection 52 of the second insulating member 38 to the second recess 26 of the mounting portion 16, the first projection 42 of the first insulating member 36 contacts the inner surface of the first recess 22 of the mounting portion 16 and the second projection 52 of the second insulating member 38 contacts the inner surface of the second recess 26 of the mounting portion 16 if the insulating member 18 is going to be displaced in the front-rear direction. Therefore, a displacement of the insulating member 18 in the front-rear direction is restricted.

Further, the first and second insulating members 36, 38 can be joined by press-fitting the first projecting portion 58 of the second insulating member 38 into the opening 46 of the first insulating member 36.

Further, since the inner surface of the first groove portion 56 is in surface contact with the front end surface 28 and the first inclined surface 30 of the mounting portion 16 of the body portion 12, a displacement of the insulating member 18 in the thickness direction of the plate terminal (terminal) 10 can be suppressed.

Note that the first inclined surface 30 of the mounting portion 16 of the body portion 12 is preferably provided in the width direction of the entire mounting portion 16, for example, as shown in FIG. 5. Similarly, the first groove portion 56 is also preferably provided in the entire mounting portion 16 in the width direction. The above configuration is preferable from the perspective of being able to secure a larger contact area of the first groove portion 56 and the first inclined surface 30.

Note that being provided in the entire mounting portion 16 in the width direction means the formation of the first inclined surface 30 from one end side to another end side in the width direction of the mounting portion 16, for example, in the case of the first inclined surface 30.

Further, since the inner surface of the second groove portion 44 of the first insulating member 36 is in surface contact of the first side surface (side surface on the one side) and the second inclined surface 32 of the mounting portion 16 and the inner surface of the third groove portion 54 of the first covering portion 48 of the second insulating member 38 is in surface contact with the second end surface (side surface on the other side) and the third inclined surface 34, a displacement of the insulating member 18 in the thickness direction of the plate terminal (terminal) 10 can be suppressed.

Note that the second and third inclined surfaces 32, 34 are preferably provided in the entire mounting portion 16 in the front-rear direction, for example, as shown in FIG. 5. Similarly, the second groove portion 44 and the third groove portion 54 are also preferably provided in the entire mounting portion 16 in the front-rear direction. The above configuration is preferable from the perspective of being able to secure a larger contact area of the second groove portion 44 and the second inclined surface 32 and a larger contact area of the third groove portion 54 and the third inclined surface 34.

Second Embodiment

A plate terminal 10A of a second embodiment is described with reference to FIGS. 12 to 16. In the plate terminal 10A, an insulating member 18A is composed of one member unlike the plate terminal 10 of the first embodiment.

Figure 15:
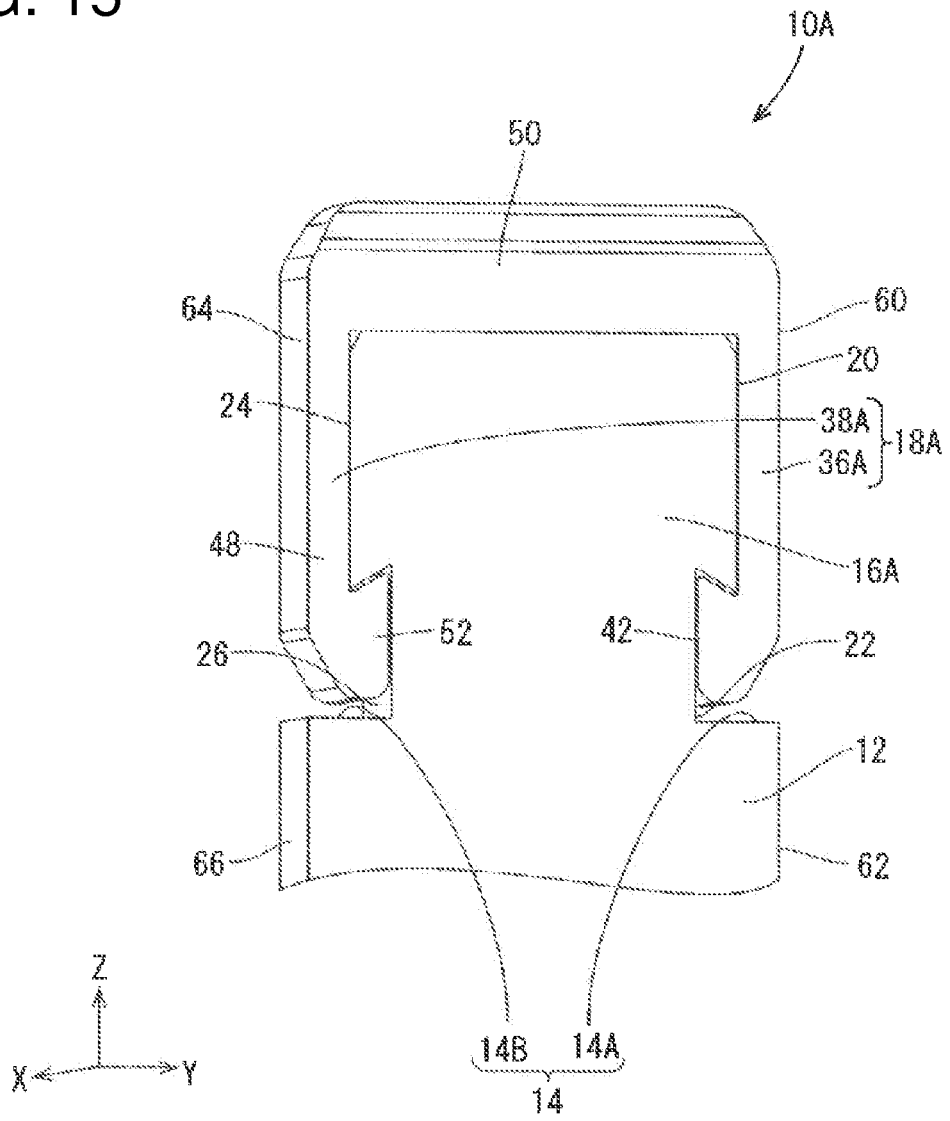
FIG. 15 is an enlarged perspective view near a mounting portion of the terminal.
Figure 16:
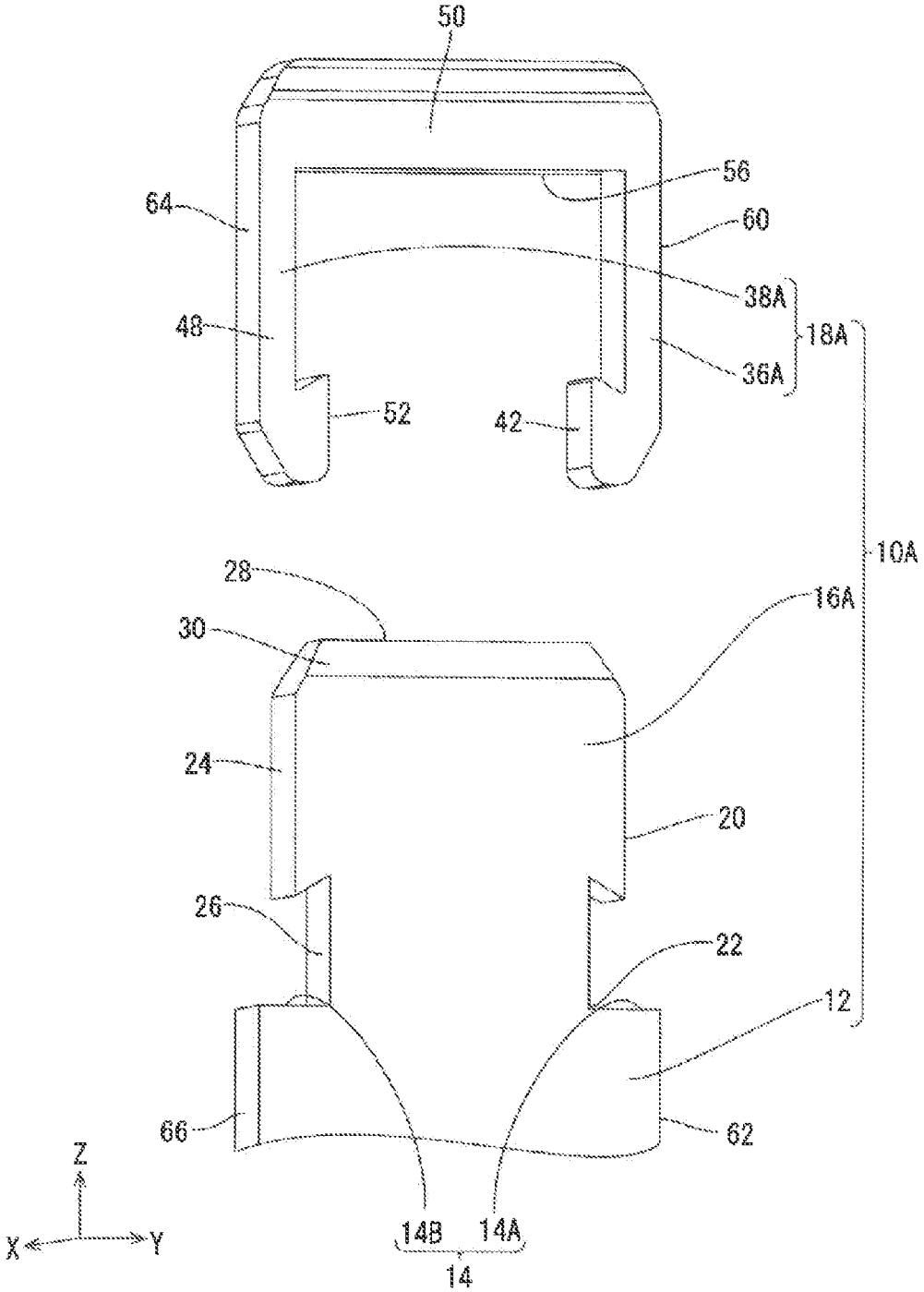
FIG. 16 is a view, corresponding to FIG. 15, showing the state where the insulating member is separated from the body portion.

As shown in FIGS. 15 and 16, the plate terminal 10A is composed of a body portion 12 made of metal and in the form of a plate long in the front-rear direction, a plate-like mounting portion 16A connected to the body portion 12 and projecting forward from a front end surface 14 of the body portion 12, and a separate insulating member 18 to be mounted on the mounting portion 16 from front.

A groove-like first recess 22 is provided in a first side surface 20, which is a side surface on one widthwise side of the mounting portion 16A, and a groove-like second recess 26 is provided in a second side surface 24, which is a side surface on another other widthwise side of the mounting portion 16A.

A first inclined surface 30 inclined toward a front end surface 28 of the mounting portion 16A is provided on a front end part of a plate surface of the mounting portion 16A.

The insulating member 18A is composed of a first insulating member 36A and a second insulating member 38A integrally provided to the first insulating member 36A.

The first insulating member 36A is shaped to be long in the front-rear direction and mounted on the side of the side surface 20 on one side of the mounting portion 16A, and a first projection 42 is provided to project on a side surface on the other widthwise side of the first insulating member 36A.

The first projection 42 is provided at a position corresponding to the first recess 22 of the mounting portion 16A. If the insulating member 18A is mounted on the mounting portion 16A, the first projection 42 is fit to the first recess 22 of the mounting portion 16A. In this way, the first projection 42 comes into contact with an inner surface of the first recess 22 if the insulating member 18A is going to be displaced in the front-rear direction. Thus, a displacement of the first insulating member 36A in the front-rear direction is restricted.

As shown in FIGS. 15 and 16, the second insulating member 38A is composed of a second covering portion 50 shaped to be long in the width direction and connected to an upper end part of the first insulating member 36A and a first covering portion 48 projecting rearward from an end part of the second covering portion 50 on a side opposite to an end part connected to the first insulating member 36A.

A second projection 52 is provided to project on a side surface on the one widthwise side of the first covering portion 48 (side surface facing the second side surface 24 of the mounting portion 16A).

The second projection 52 is provided at a position corresponding to the second recess 26 of the mounting portion 16A. If the insulating member 18A is mounted on the mounting portion 16A, the second projection 52 of the first covering portion 48 is fit to the second recess 26 of the mounting portion 16A.

By fitting the first projection 42 to the first recess 22 and fitting the second projection 52 to the second recess 26, the first projection 42 comes into contact with the inner surface of the first recess 22 and the second projection 52 comes into contact with the inner surface of the second recess 26 if the insulating member 18A is going to be displaced in the front-rear direction. Thus, a displacement of the insulating member 18A in the front-rear direction is restricted.

Figure 13:
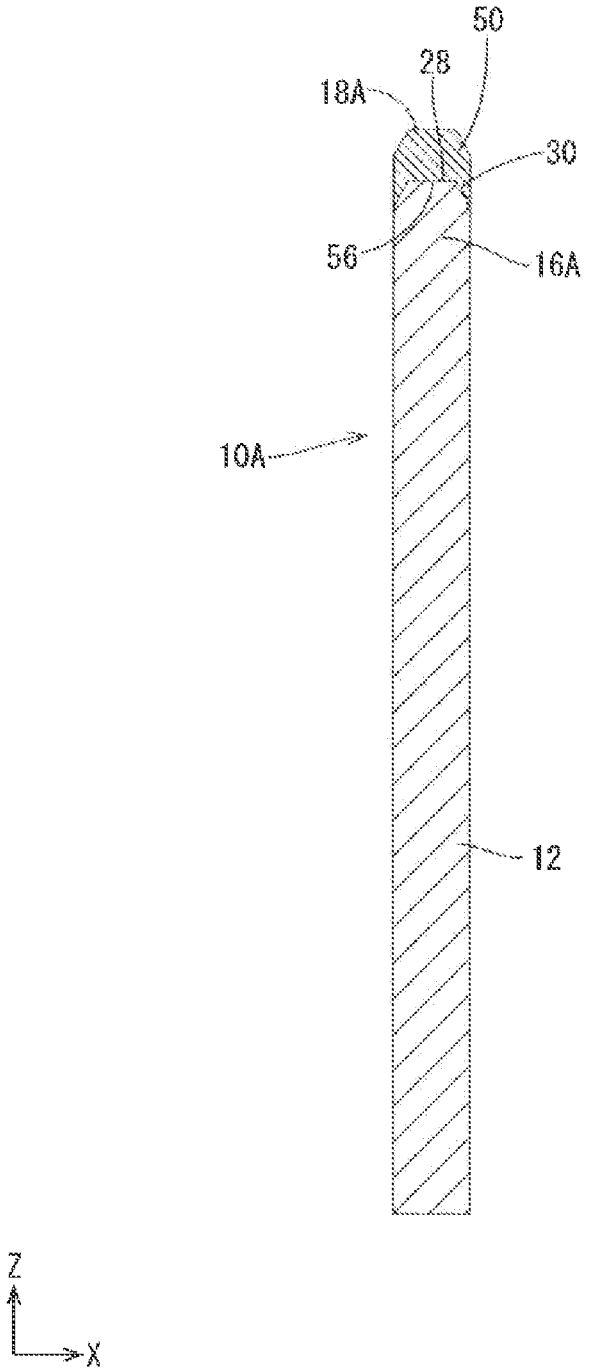
FIG. 13 is a section along A-A in FIG. 12.
Figure 14:
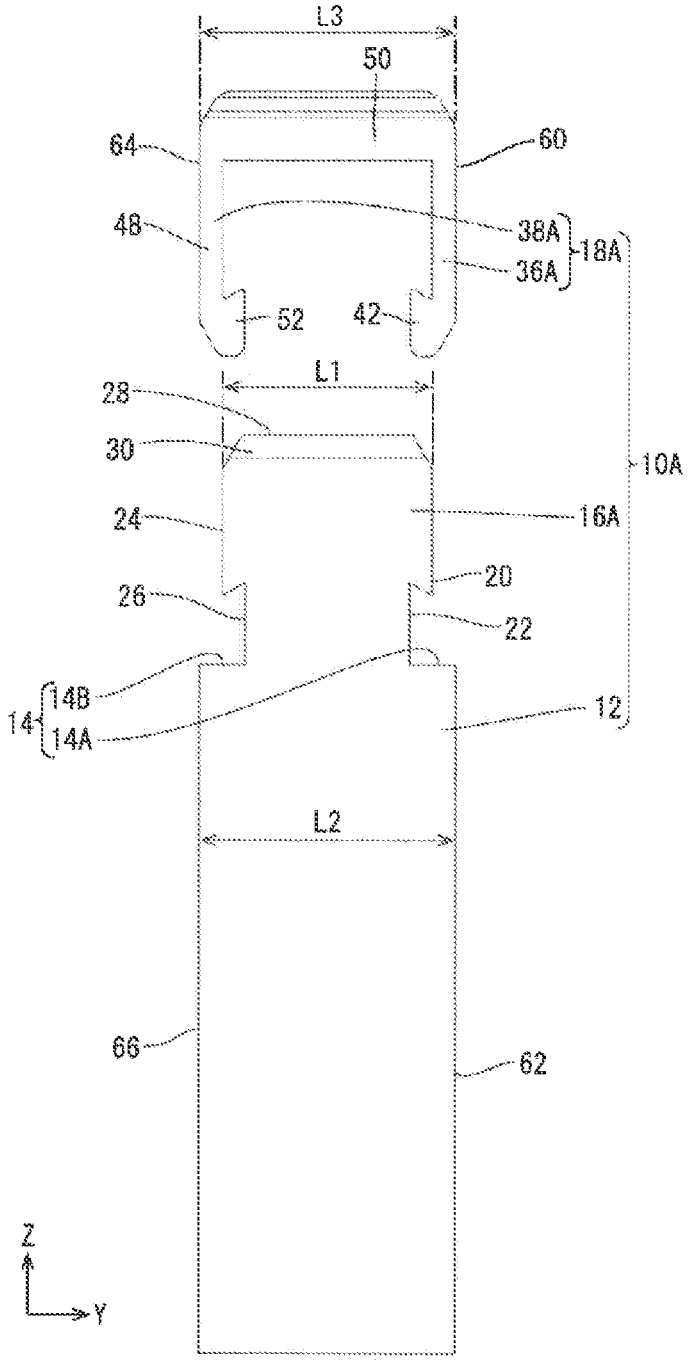
FIG. 14 is a view, corresponding to FIG. 12, showing a state where an insulating member is separated from a body portion.

As shown in FIG. 13, a first groove portion 56 long in the width direction is provided to be open in a rear surface of the second covering portion 50. The first groove portion 56 is provided at a position corresponding to the first inclined surface 30 of the mounting portion 16A and the front end surface 28 of the mounting portion 16A, and an inner surface of the first groove portion 56 is in surface contact with the first inclined surface 30 of the mounting portion 16A and the front end surface 28 of the mounting portion 16A. In this way, a displacement of the insulating member 18A in the thickness direction is suppressed.

The first insulating member 36A and the first covering portion 48 are resiliently displaceable in the width direction. In this way, when the insulating member 18A is mounted on the mounting portion 16A from front, the front end of the mounting portion 16A contacts the rear end of the first insulating member 36A and the rear end of the first covering portion 48, and the first insulating member 36A and the first covering portion 48 are resiliently displaced in directions separating from each other. In this state, the insulating member 18A can be mounted on the mounting portion 16A by being displaced rearward until the first projection 42 is fit to the first recess 42 and the second projection 52 is fit to the second recess 26. Since the insulating member 18A can be mounted on the mounting portion 16A by being assembled as just described, easy mounting is possible as compared to the case where the insulating member 18A is mounted on the mounting portion 16A by insert molding.

Since the other components are the same as in the plate terminal 10 of the first embodiment, these components are denoted by the same reference signs as in the first embodiment and not described.

As described above, according to this embodiment, a displacement of the insulating member 18A in the front-rear direction from the body portion 12 is restricted and the detachment of the insulating member 18A from the body portion 12 is suppressed by fitting the first projection (first fitting portion) 42 of the first insulating member 36A to the first recess (third fitting portion) 22 of the mounting portion 16A and fitting the second projection (second fitting portion) 52 of the first covering portion 48 of the second insulating member 38A to the second recess (fourth fitting portion) 26 of the mounting portion 16A.

Further, a displacement of the insulating member 18A in the front-rear direction from the body portion 12 is restricted and the detachment of the insulating member 18A from the body portion 12 is suppressed by fitting the first projection 42 of the first insulating member 36A to the first recess 22 of the mounting portion 16A and fitting the second projection 52 of the first covering portion 48 of the second insulating member 38A to the second recess 26 of the mounting portion 16A.

Further, since the first insulating member 36A and the first covering portion 48 of the second insulating member 38A are resiliently displaceable in the width direction, the first projection (first fitting portion) 42 and the second projection (second fitting portion) 52 of the insulating member 18A can be displaced to the positions of the first recess (third fitting portion) 22 and the second recess (fourth fitting portion) 26 of the mounting portion 16A by resiliently displacing the first insulating member 36A and the first covering portion 48 of the second insulating member 38A when the first projection (first fitting portion) 42 and the second portion (second fitting portion 52) of the insulating member 18A are fit to the first recess (third fitting portion) 22 and the second recess (fourth fitting portion) 26 of the mounting portion 16A. Since the insulating member 18A can be mounted on the mounting portion 16A by being assembled in this way, easy mounting is possible as compared to the case where an insulating member is mounted on a mounting portion by insert molding.

Further, since the inner surface of the first groove portion 56 is in surface contact with the front end surface 28 and the first inclined surface 30 of the mounting portion 16A of the body portion 12, a displacement of the insulating member 18A in the thickness direction of the plate terminal (terminal) 10A can be suppressed.

Third Embodiment

Figure 17:
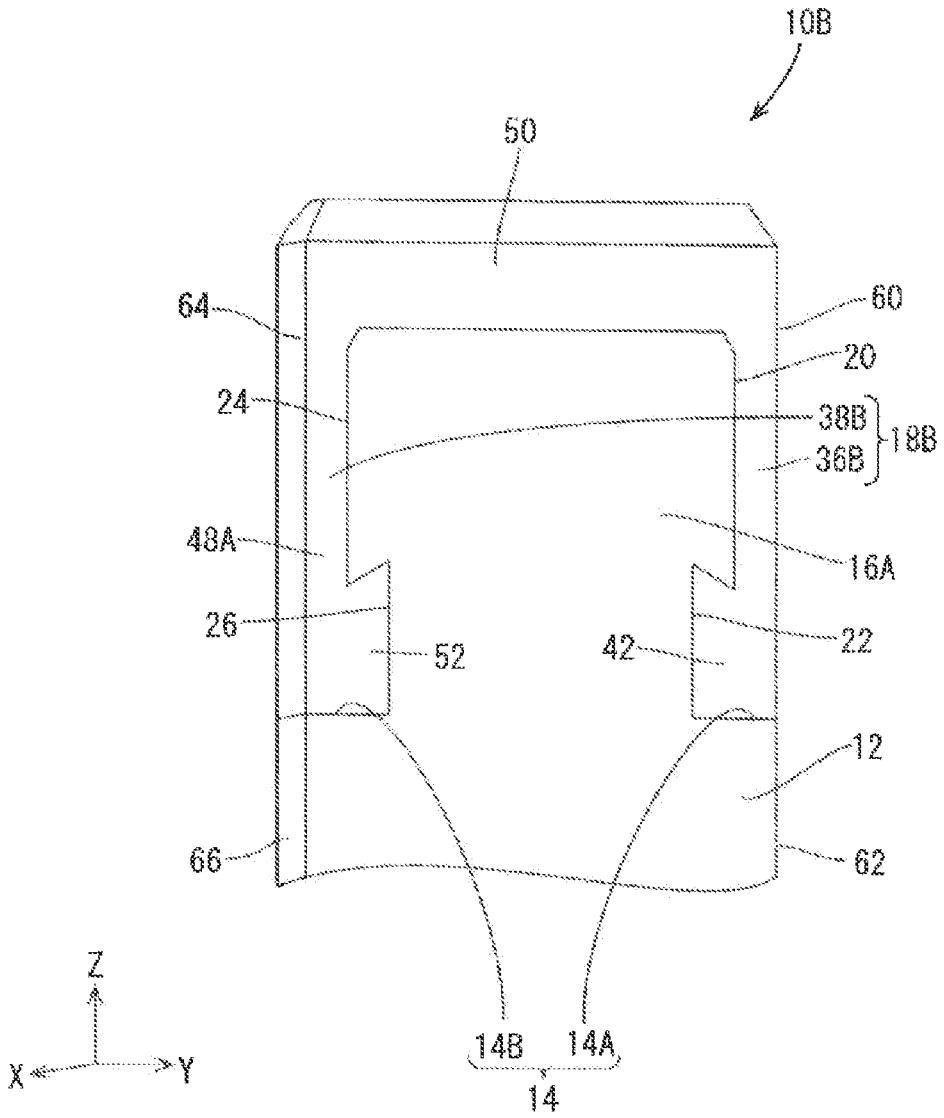
FIG. 17 is an enlarged perspective view near a mounting portion of a terminal in a third embodiment.
Figure 18:
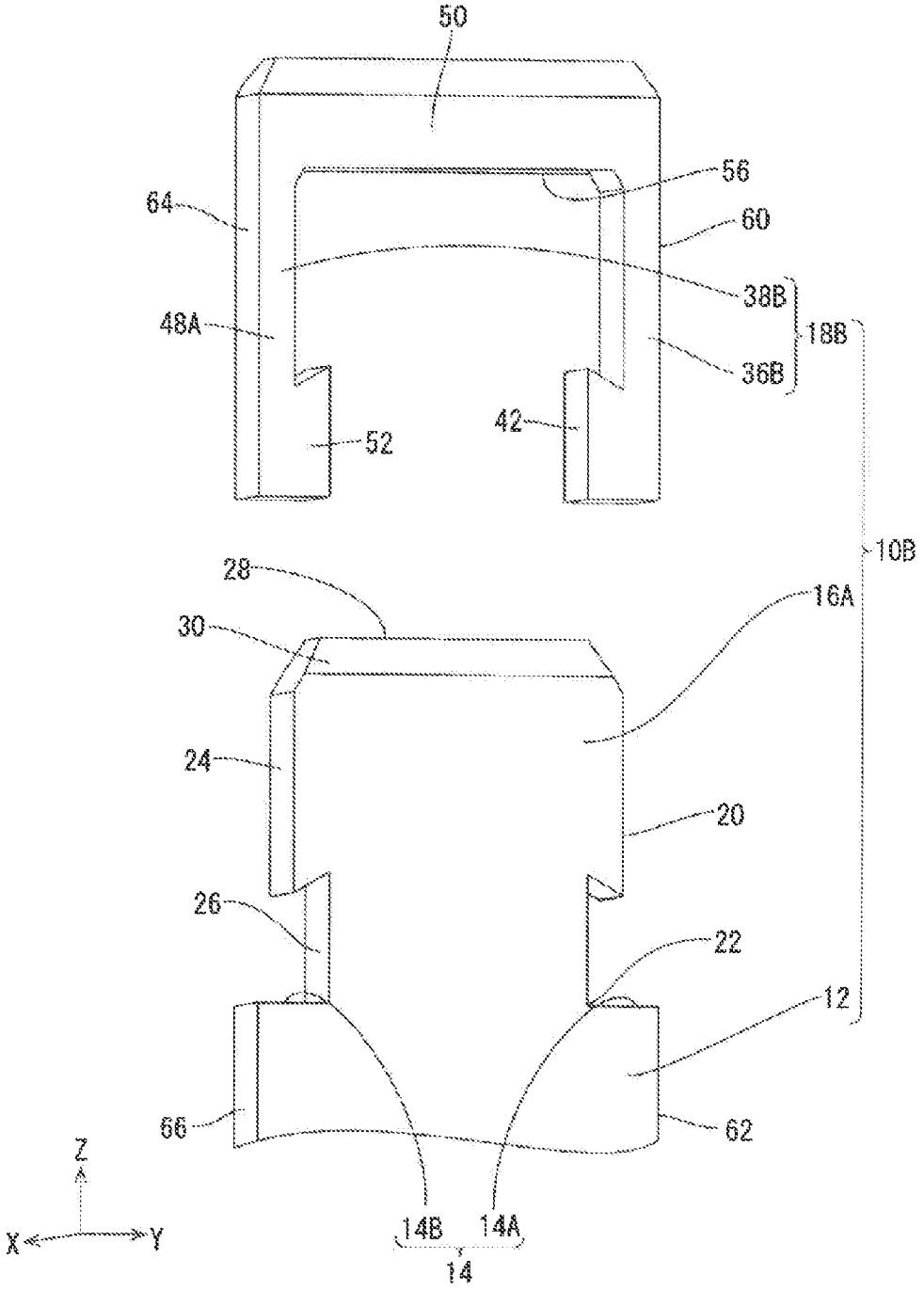
FIG. 18 is a view, corresponding to FIG. 17, showing a state where an insulating member is separated from a body portion.

A plate terminal 10B of a third embodiment is described with reference to FIGS. 17 and 18. An insulating member 18B of the plate terminal 10B is composed of one member similarly to the plate terminal 10A of the second embodiment, but mounted on a mounting portion 16A by insert molding unlike the plate terminal 10A of the second embodiment.

A first insulating member 36B and a first covering portion 48A of a second insulating member 38B of the insulating member 18B are configured not to be resiliently displaceable in the width direction unlike the plate terminal 10A in the second embodiment, so that the insulating member 18B is less likely to be detached from the mounting portion 16A than in the plate terminal 10A of the second embodiment.

Fourth Embodiment

Figure 19:
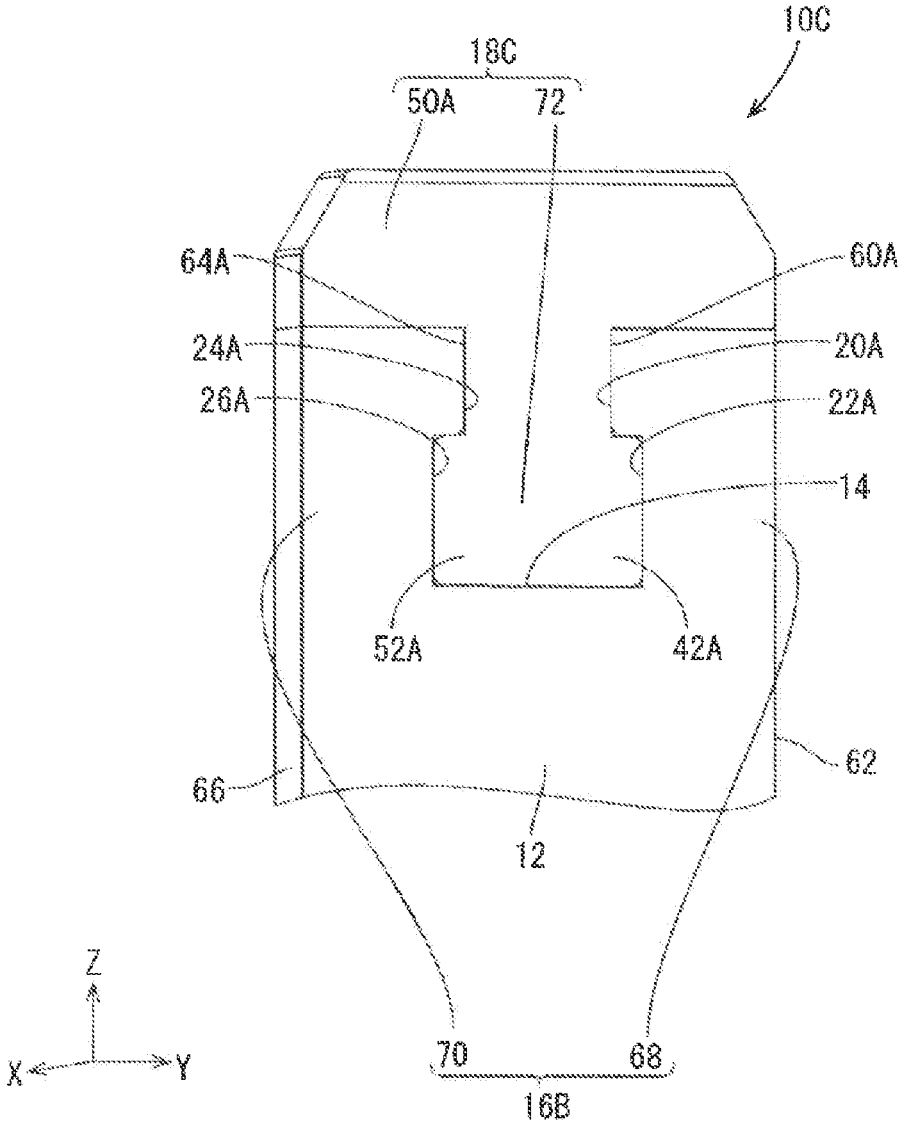
FIG. 19 is an enlarged perspective view near a mounting portion of a terminal in a fourth embodiment.
Figure 20:
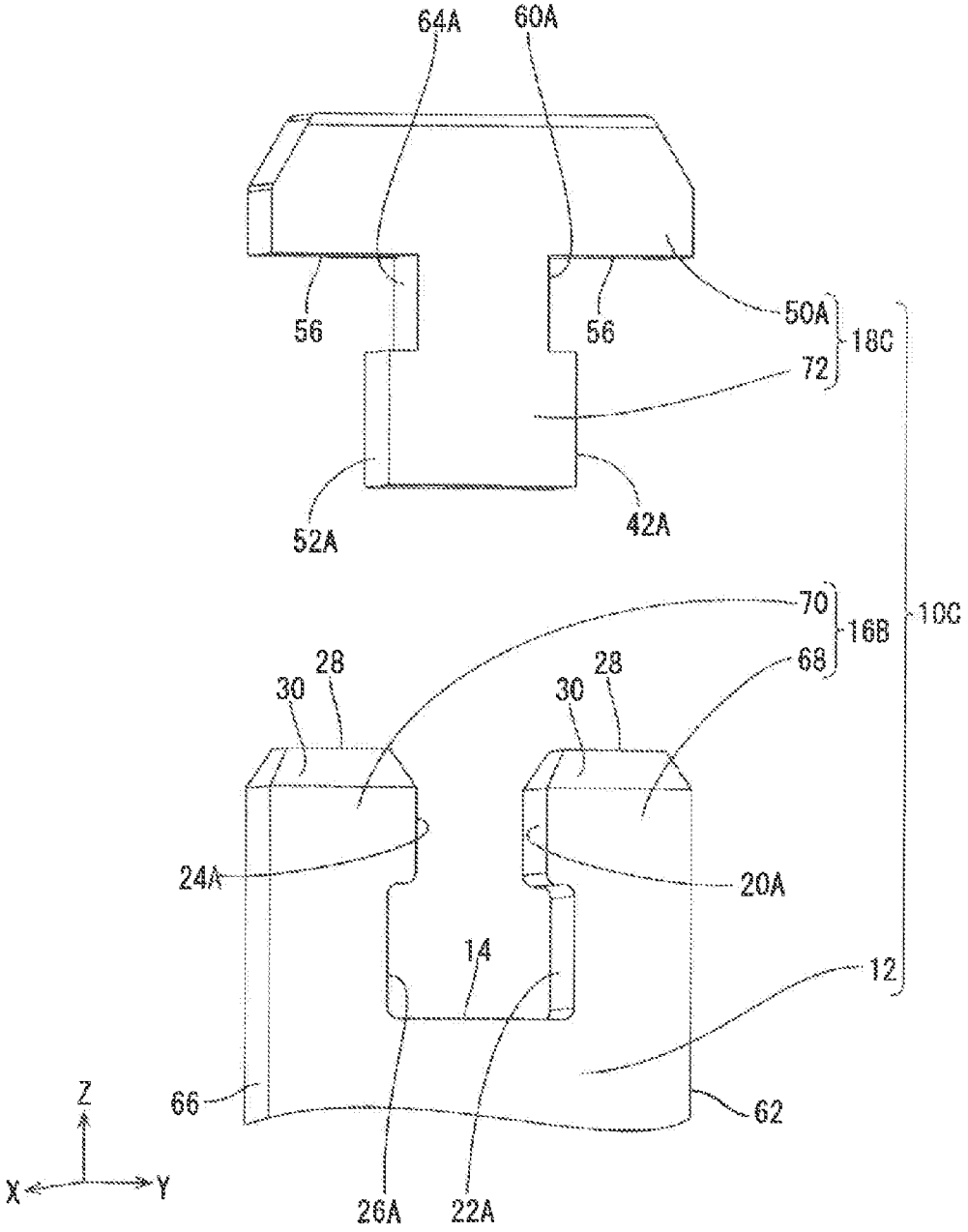
FIG. 20 is a view, corresponding to FIG. 19, showing a state where an insulating member is separated from a body portion.

A plate terminal 10C of a fourth embodiment is described with reference to FIGS. 19 and 20. An insulating member 18C of the plate terminal 10C is mounted on a mounting portion 16B by insert molding similarly to the plate terminal 10B of the third embodiment, but the shapes of the insulating member 18C and the mounting portion 16B are different from those of the insulating member 18B and the mounting portion 16A in the third embodiment.

The mounting portion 16B is composed of a first mounting portion 68 projecting forward from an end part on one widthwise side of a front end surface 14 of a body portion 12 and a second mounting portion 70 projecting forward from an end part on another widthwise side of the front end surface 14 of the body portion 12. The first and second mounting portions 68, 70 are disposed at a predetermined interval in the width direction.

The insulating member 18C is composed of a second covering portion 50A shaped to be long in the width direction, provided from the first mounting portion 68 to the second mounting portion 70 and configured to cover front end surfaces 28 of the first and second mounting portions 68, 70 and the front end surface 14 of the body portion 12, and a second projecting portion 72 projecting toward a gap between the first and second mounting portions 68 and 70 from the rear surface of the second covering portion 50.

Out of both side surfaces in the width direction of the second projecting portion 72, a first projection (first fitting portion) 42A is provided to project on a side surface 60A on one side and a second projection (second fitting portion) 52A is provided to project on a side surface 64A on another side.

A first recess (third fitting portion) 22A to be fit to the first projection 42A is provided in a first side surface 20A of the first mounting portion 68 facing the side surface 60A on the one side of the second projecting portion 72, and a second recess (fourth fitting portion) 26A to be fit to the second projection (second fitting portion) 52A is provided in a surface 24A of the second mounting portion 70 facing the side surface 64A on the other side of the second projecting portion 72. By fitting the first projection 42A and the first recess 22A and fitting the second projection 52A and the second recess 26A, a displacement of the insulating member 18C in the front-rear direction from the mounting portion 16B is restricted and the detachment of the insulating member 18C from the mounting portion 16B is suppressed.

Since the other components are the same as in the plate terminal 10B of the third embodiment, these components are denoted by the same reference signs as in the third embodiment and not described.

As described above, according to this embodiment, a displacement of the insulating member 18C in the front-rear direction from the mounting portion 16B is restricted and the detachment thereof from the mounting portion 16B is suppressed by fitting the first projection (first fitting portion) 42A of the insulating member 18C to the first recess (third fitting portion) 22A of the mounting portion 16B and fitting the second projection (second fitting portion) 52A of the insulating member 18C to the second recess (fourth fitting portion) 26A of the mounting portion 16B.

Fifth Embodiment

Figure 21:
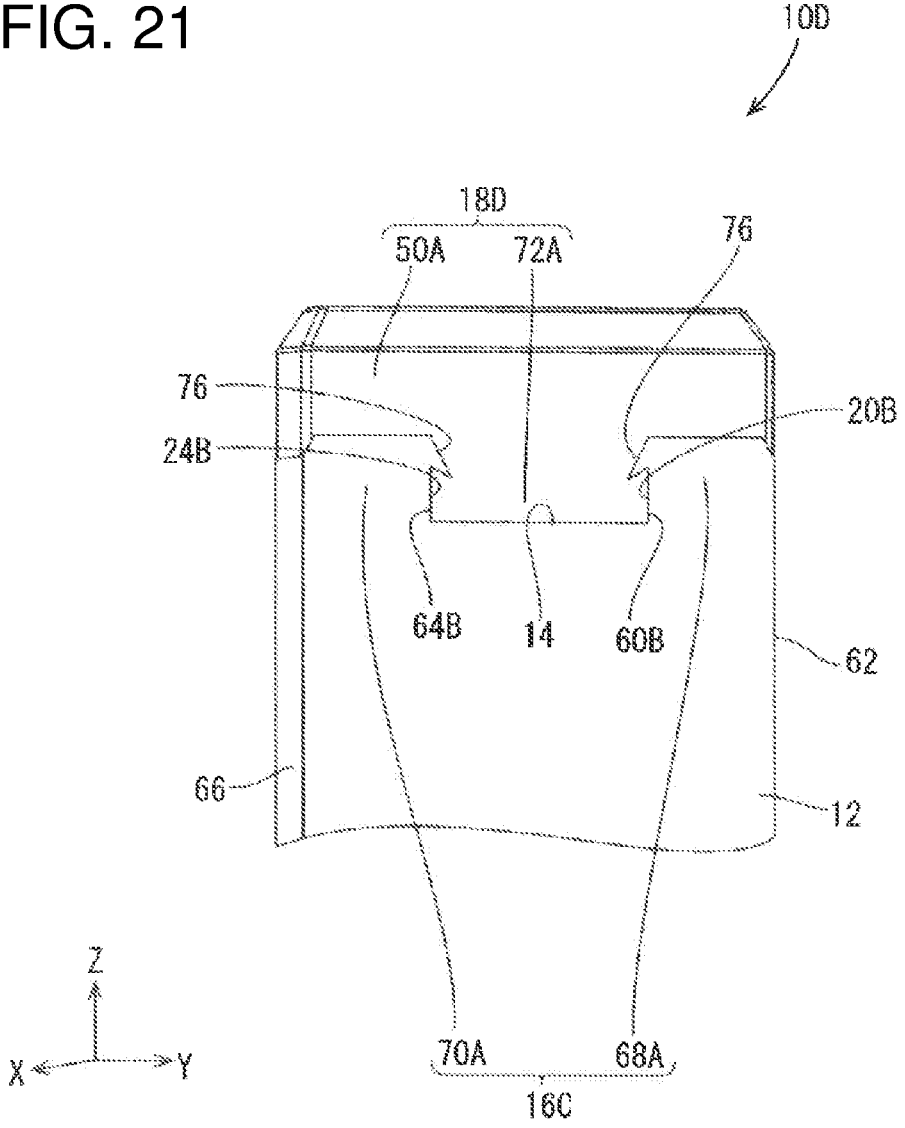
FIG. 21 is an enlarged perspective view near a mounting portion of a terminal in a fifth embodiment.
Figure 22:
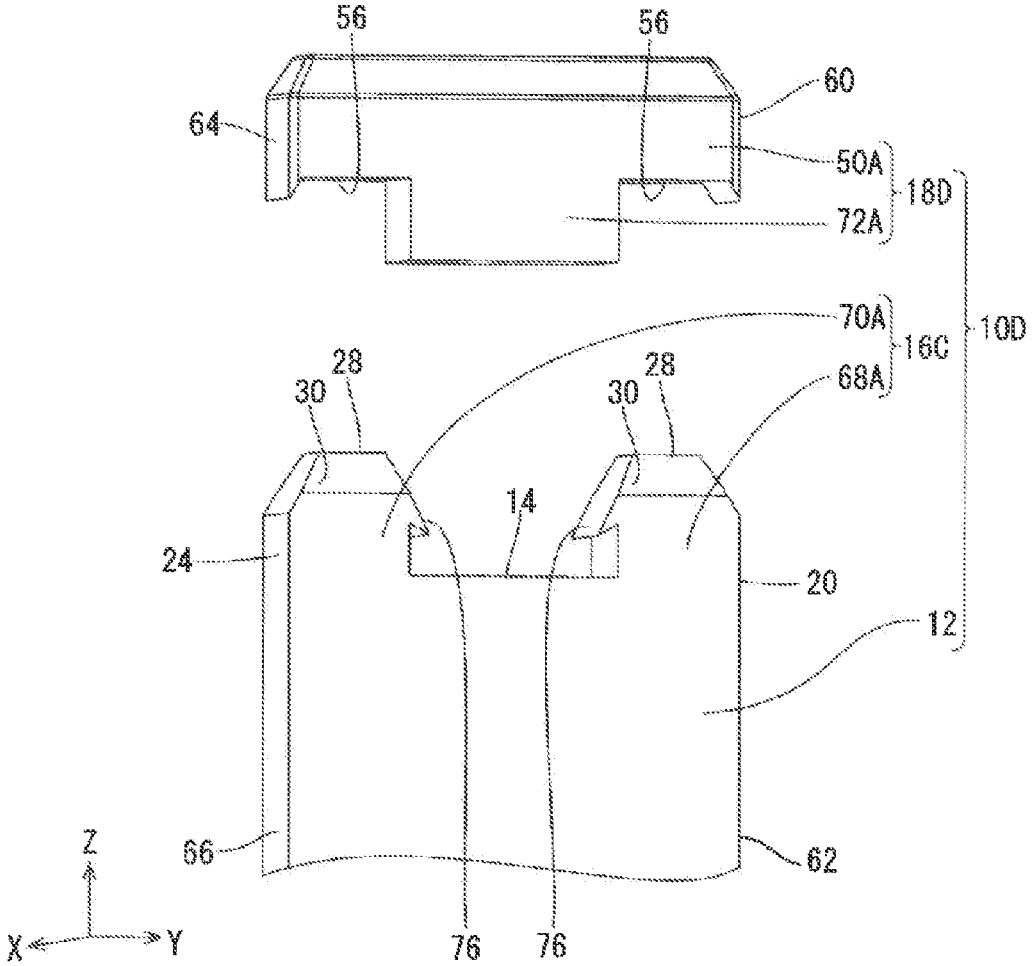
FIG. 22 is a view, corresponding to FIG. 21, showing a state where an insulating member is separated from a body portion.

A plate terminal 10D of a fifth embodiment is described with reference to FIGS. 21 and 22. The plate terminal 10D differs from the plate terminal 10C of the fourth embodiment in that an insulating member 18D is mounted on a mounting portion 16C by press-fitting.

The mounting portion 16C is composed of a first mounting portion 68A projecting forward from an end part on one widthwise side of a front end surface 14 of a body portion 12 and a second mounting portion 70A projecting forward from an end part on another widthwise side of the front end surface 14 of the body portion 12. The first and second mounting portions 68A, 70A are disposed at a predetermined interval in the width direction. A pair of protrusions 76 are provided to project on a first side surface 20B and a second side surface 24B of the first and second mounting portions 68A, 70A facing each other.

The insulating member 18D is composed of a second covering portion 50A shaped to be long in the width direction, provided from the first mounting portion 68A to the second mounting portion 70A and configured to cover front end surfaces 28 of the first and second mounting portions 68A, 70A and the front end surface 14 of the body portion 12, and a second projecting portion 72A projecting toward a gap between the first and second mounting portions 68A and 70A from the rear surface of the second covering portion 50.

A length between the tips of the pair of protrusions 76 is shorter than a length in the width direction of the second projecting portion 72A of the insulating member 18D, and the insulating member 18D is mounted on the mounting portion 16C by press-fitting.

Since the other components are the same as in the plate terminal 10C of the fourth embodiment, these components are denoted by the same reference signs as in the fourth embodiment and not described.

Sixth Embodiment

Figure 23:
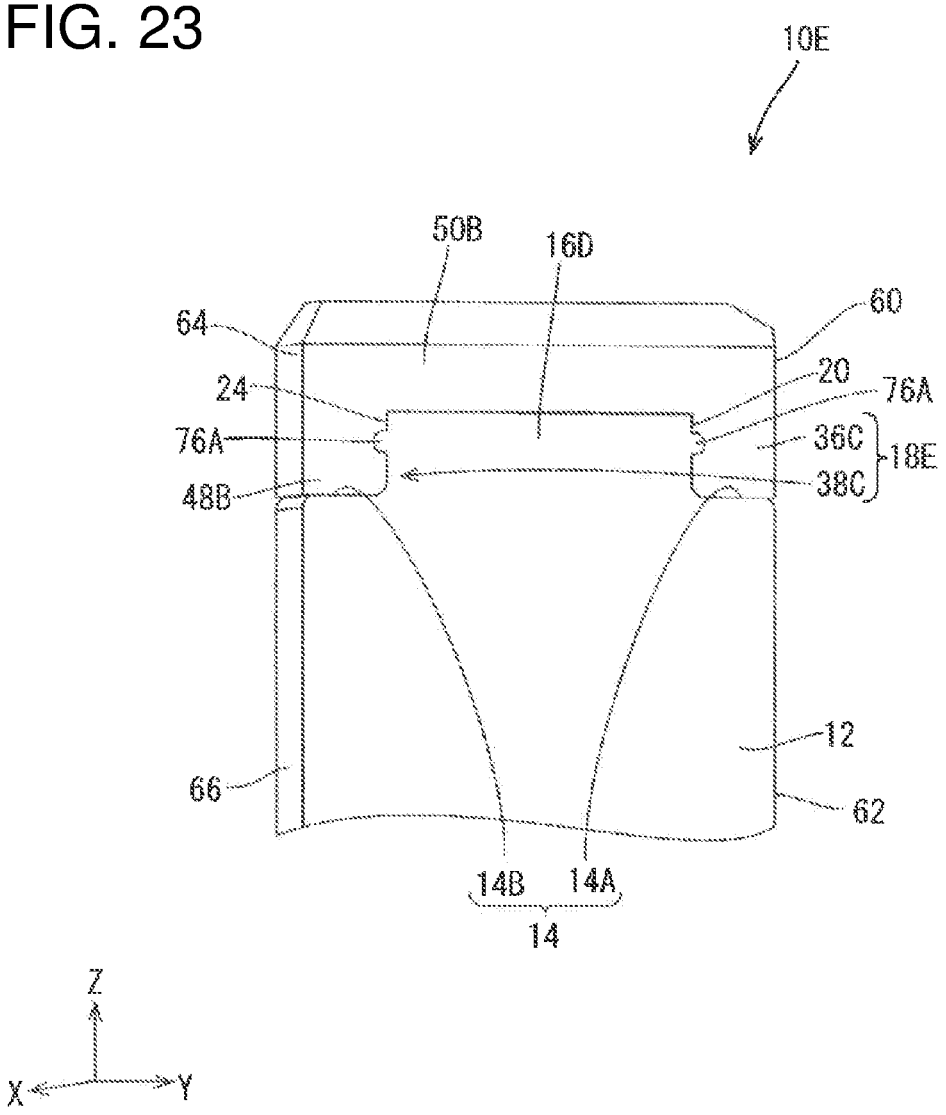
FIG. 23 is an enlarged perspective view near a mounting portion of a terminal in a sixth embodiment.
Figure 24:
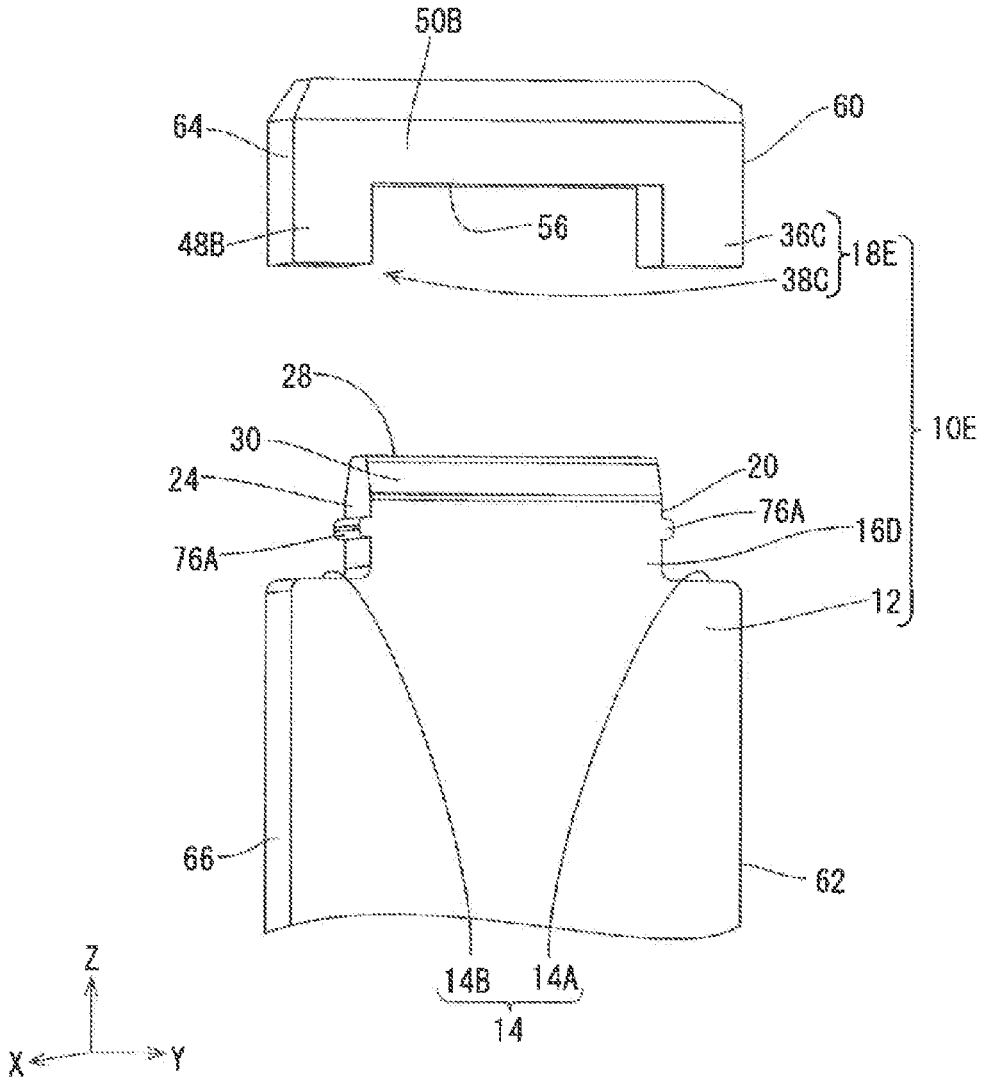
FIG. 24 is a view, corresponding to FIG. 23, showing a state where an insulating member is separated from a body portion.

A plate terminal 10E of a sixth embodiment is described with reference to FIGS. 23 and 24. The plate terminal 10E differs from the plate terminal 10B of the third embodiment in that an insulating member 18E is mounted on a mounting portion 16D by press-fitting.

The mounting portion 16D is provided to project forward from a front end surface 14 of a body portion 12, and a pair of protrusions 76A are provided to project on a first side surface 20 on one side and a second side surface 24 on another side of the mounting portion 16D.

The insulating member 18E is composed of a first insulating member 36C and a second insulating member 38C integrally provided to the first insulating member 36C. The first insulating member 36C is shaped to be long in the front-rear direction, and mounted on the side of the first side surface 20 on the one side of the mounting portion 16D. The second insulating member 38C is composed of a second covering portion 50B shaped to be long in the width direction and connected to an upper end part of the first insulating member 36C and a first covering portion 48B projecting rearward from an end part of the second covering portion 50B on a side opposite to an end part connected to the first insulating member 36C.

A length between the tips of the pair of protrusions 76A is longer than a length between the first insulating member 36C and the first covering portion 48B of the second insulating member 38C of the insulating member 18E, and the insulating member 18E is mounted on the mounting portion 16D by press-fitting.

Since the other components are the same as in the plate terminal 10B of the third embodiment, these components are denoted by the same reference signs as in the third embodiment and not described.

Seventh Embodiment

Figure 25:
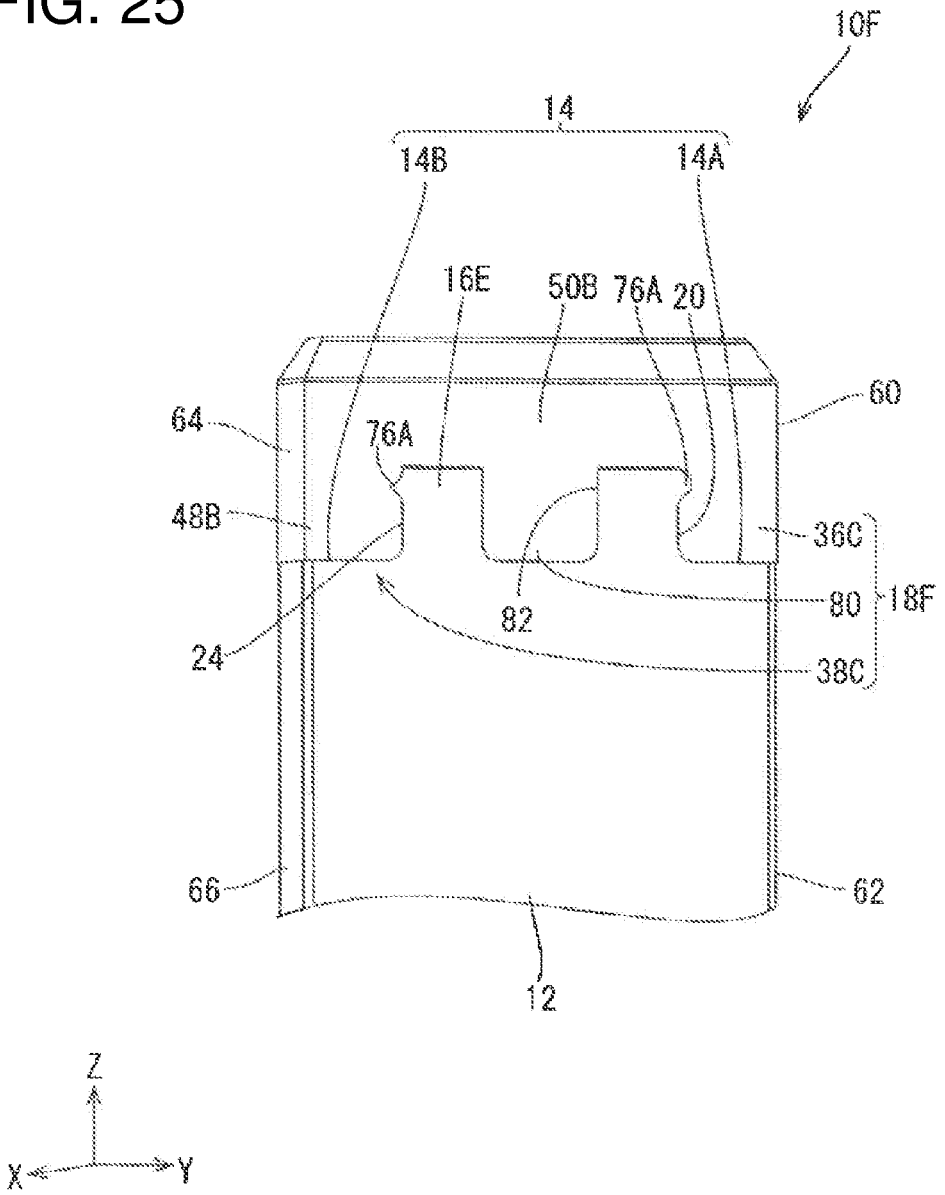
FIG. 25 is an enlarged perspective view near a mounting portion of a terminal in a seventh embodiment.
Figure 26:
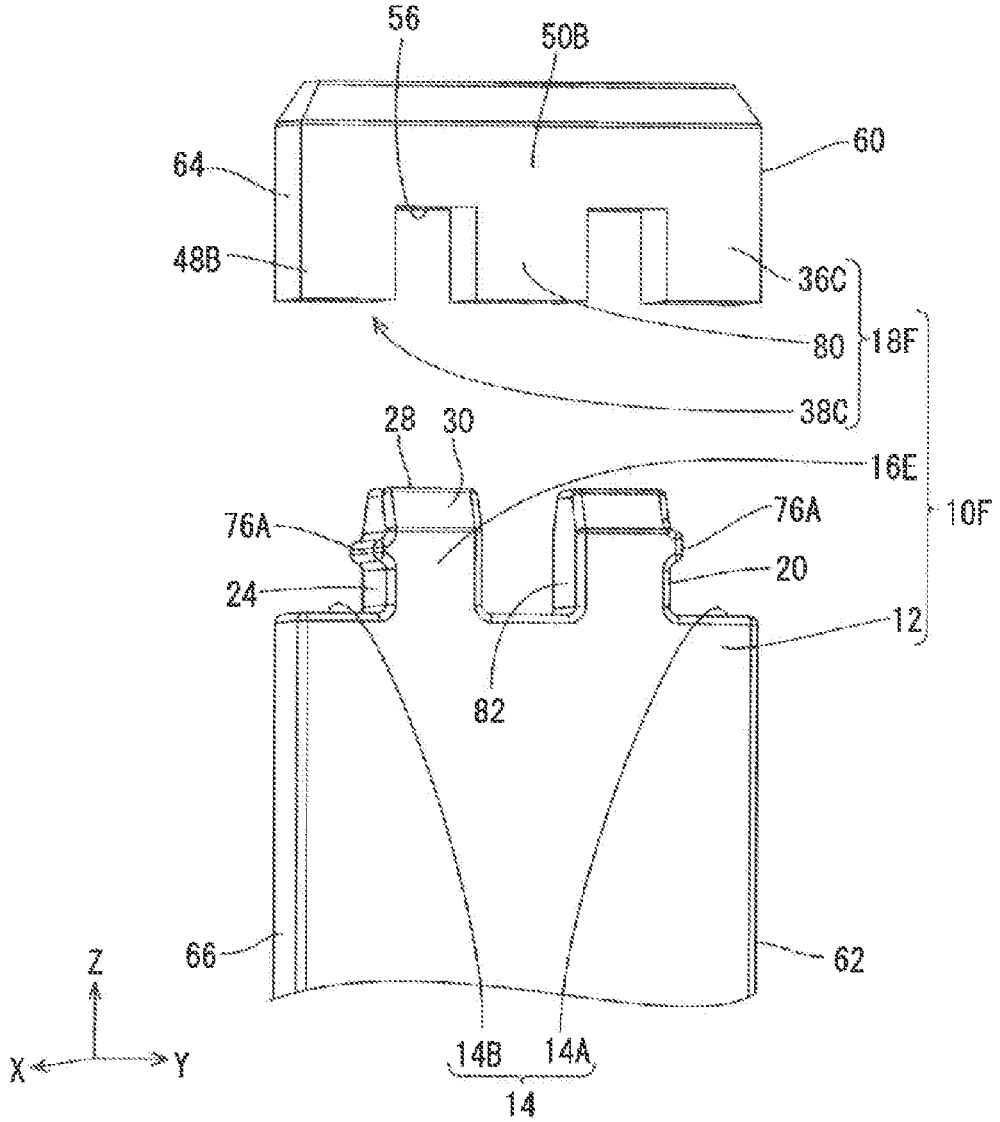
FIG. 26 is a view, corresponding to FIG. 25, showing a state where an insulating member is separated from a body portion.

A plate terminal 10F of a seventh embodiment is described with reference to FIGS. 25 and 26. The plate terminal 10F is similar to the plate terminal 10E of the sixth embodiment in that an insulating member 18F is mounted on a mounting portion 16E by press-fitting, but differs from the plate terminal 10E of the sixth embodiment in that the mounting portion 18F is provided with a fourth recess 82 to be fit to a third projection 80.

The third projection 80 is provided between a first insulating member 36C and a first covering portion 48B of a second insulating member 38C of the insulating member 18F and projects rearward from the rear surface of the second covering portion 50B. The fourth recess 82 is provided to be open at a position corresponding to the third projection 80 on the front end of the mounting portion 16E. By providing the third projection 80 and the fourth recess 82, positioning becomes easier in mounting the insulating member 18F on the mounting portion 16E and the insulating member 18F can be easily mounted on the mounting portion 16E as compared to the plate terminal 10E of the sixth embodiment.

Since the other components are the same as in the plate terminal 10E of the sixth embodiment, these components are denoted by the same reference signs as in the sixth embodiment and not described.

Other Embodiments

The technique disclosed by this specification is not limited to the described and illustrated embodiments. For example, the following various modes are also included.

(1) Although the first and second insulating members 36, 38 are joined by press-fitting the first projecting portion 58 of the second covering portion 50 of the second insulating member 38 into the opening 46 of the first insulating member 36 in the first embodiment, a first insulating member and a second insulating member may be, for example, joined by welding or ultrasonic bonding.

(2) Although a displacement of the first insulating member 36 in the front-rear direction is restricted by fitting the first projection 42 provided on the first insulating member 36 to the first recess 22 provided in the mounting portion 16 in the first embodiment, a recess may be provided in a first insulating member, a projection may be provided on a mounting portion and the recess of the first insulating member may be fit to the projection of the mounting portion.

(3) Although a displacement of the second insulating member 38 in the front-rear direction is restricted by fitting the second projection 52 provided on the second insulating member 38 to the second recess 26 provided in the mounting portion 16 in the first embodiment, a recess may be provided in a second insulating member, a projection may be provided on a mounting portion and the recess of the second insulating member may be fit to the projection of the mounting portion.

(4) Although the first insulating member 36 is mounted from the side of the first side surface 20 of the mounting portion 16 and the second insulating member 38 is mounted from the side of the second side surface 24 of the mounting portion 16 in the first embodiment, one insulating member may be mounted on a mounting portion by press-fitting.

(5) Although the first and second insulating members 36, 38 are configured to cover the entire first and second front end surfaces 14A, 14B of the body portion 12 in the first embodiment, the first and second insulating members 36, 38 may cover parts of the first and second front end surfaces 14A, 14B.

(6) Although the length L2 in the width direction of the body portion is equal to the sum L3 of the lengths in the width direction of the first and second insulating members 36, 38 in the first embodiment, L3 may be shorter than L2.

(7) Although the insulating member 18 is composed of the first and second insulating members 36, 38 in the first embodiment, there is no limitation to this. For example, a first insulating member and a second insulating member may constitute a unitary member.

LIST OF REFERENCE NUMERALS

10, 10A, 10B, 10C, 10D, 10E, 10F: plate terminal (terminal)
12: body portion
14: front end surface
14A: first front end surface
14B: second front end surface
16, 16A, 16B, 16C, 16D, 16E: mounting portion

18, 18A, 18B, 18C, 18D, 18E, 18F: insulating member
20, 20A, 20B: first side surface (side surface on one side)
22, 22A: first recess (third fitting portion)
24, 24A, 24B: second side surface (side surface on another side)
26, 26A: second recess (fourth fitting portion)
28: front end surface
30: first inclined surface
32: second inclined surface
34: third inclined surface
36, 36A, 36B, 36C: first insulating member
38, 38A, 38B, 38C: second insulating member
40A: contact surface
40B: contact surface
42, 42A: first projection (first fitting portion)
44: second groove portion
46: opening
48, 48A, 48B: first covering portion
50, 50A, 50B: second covering portion
52, 52A: second projection (second fitting portion)
54: third groove portion
56: first groove portion
58: first projecting portion
60, 60A, 60B: side surface on one side
62: side surface on one side
64, 64A, 64B: side surface on another side
66: side surface on another side
72, 72A: second projecting portion
L1: length
L2: length

What is claimed is:

1. A terminal, comprising:

a plate-like body portion made of metal and long in a front-rear direction; and a mounting portion connected to the body portion, a separate insulating member being mounted on the mounting portion, wherein:

the mounting portion is plate-like and projects forward from a front end surface of the body portion, the insulating member is located forward of the front end surface of the body portion and covers at least parts of a front end surface of the mounting portion and the front end surface of the body portion, out of both side end parts in a width direction of a plate surface of the mounting portion, the side end part on one side has a second inclined surface thinning a plate thickness toward a side surface on the one side of the mounting portion and the side end part on another side has a third inclined surface thinning the plate thickness toward a side surface on the other side of the mounting portion, and the insulating member includes a second groove portion configured to cover at least a part of the second inclined surface and a third groove portion configured to cover at least a part of the third inclined surface.

2. The terminal according to claim 1, wherein:

the mounting portion has a first inclined surface on a front end part of the mounting portion to thin a plate thickness toward the front end surface of the mounting portion, and the insulating member includes a first groove portion behind the insulating member to cover at least a part of the first inclined surface.

3. The terminal according to claim 2, wherein the first groove portion covers the entire first inclined surface in a width direction of the mounting portion.

4. The terminal according to claim 1, wherein:

the second groove portion covers the entire second inclined surface of the mounting portion in the front-rear direction, and the third groove portion covers the third inclined surface of the mounting portion in the front-rear direction.

5. The terminal according to claim 1, wherein:

a length in a width direction of the mounting portion is set shorter than a length in the width direction of the body portion, the front end surface of the body portion is composed of a first front end surface located on one widthwise side and a second front end surface located on another widthwise side across the mounting portion, the insulating member is composed of a first insulating member to be mounted on the mounting portion from a side surface on the one side and a second insulating member to be mounted on the mounting portion from a side surface on the other side, out of both side surfaces in the width direction of the mounting portion, and the first and second insulating members are joined to each other, the first insulating member is shaped to be long in the front-rear direction, located forward of the first front end surface of the body portion and covers at least a part of the first front end surface of the body portion, and the second insulating member includes a first covering portion shaped to be long in the front-rear direction, located forward of the second front end surface of the body portion and configured to cover at least a part of the second front end surface of the body portion and a second covering portion shaped to be long in the front-rear direction, located forward of the front end surface of the mounting portion and configured to cover the front end surface of the mounting portion.

6. The terminal according to claim 5, wherein a sum of lengths in the width direction of the first and second insulating members mounted on the mounting portion is equal to or shorter than a length in the width direction of the body portion.

7. The terminal according to claim 5, wherein:

a first recess is provided to be open in the side surface on the one side of the mounting portion, a first projection to be fit to the first recess is provided to project on a surface of the first insulating member facing the side surface on the one side of the mounting portion and a displacement of the first insulating member in the front-rear direction is restricted by fitting the first recess and the first projection, a second recess is provided to be open in the side surface on the other side of the mounting portion, and a second projection to be fit to the second recess is provided to project on a surface of the first covering portion of the second insulating member facing the side surface on the other side of the mounting portion and a displacement of the second insulating member in the front-rear direction is restricted by fitting the second recess and the second projection.

8. The terminal according to claim 5, wherein:

the first insulating member and the second covering portion of the second insulating member respectively have contact surfaces to be held in contact with each other, an opening is provided in the contact surface of the first insulating member, a first projecting portion is provided to project on the contact surface of the second covering portion of the second insulating member, and the first and second insulating members are joined to each other by press-fitting the first projecting portion into the opening.

9. The terminal according to claim 5, wherein:

a first inclined surface thinning a plate thickness toward the front end surface of the mounting portion is provided on a front end part of a plate surface of the mounting portion, a first groove portion long in a width direction is provided to be open in a rear surface of the second covering portion of the second insulating member, and an inner surface of the first groove portion is in surface contact with the front end surface and the first inclined surface of the mounting portion.

10. The terminal according to claim 5, wherein:

a second inclined surface thinning a plate thickness toward the side surface on the one side of the mounting portion is provided on a side end part on the one side, out of both side end parts in a width direction of a plate surface of the mounting portion, a second groove portion long in the front-rear direction is provided to be open in a surface of the first insulating member facing the side surface on the one side of the mounting portion, an inner surface of the second groove portion is in surface contact with the side surface on the one side of the mounting portion and the second inclined surface, a third inclined surface thinning the plate thickness toward the side surface on the other side of the mounting portion is provided on the side end part on the other side, out of the both side end parts in the width direction of the plate surface of the mounting portion, a third groove portion long in the front-rear direction is provided to be open in a surface of the first covering portion of the second insulating member facing the side surface on the other side of the mounting portion, and an inner surface of the third groove portion is in surface contact with the side surface on the other side of the mounting portion and the third inclined surface.

11. The terminal according to claim 1, wherein:

a length in a width direction of the mounting portion is set shorter than a length in the width direction of the body portion, the front end surface of the body portion is composed of a first front end surface located on one widthwise side and a second front end surface located on another widthwise side across the mounting portion, the insulating member is composed of a first insulating member shaped to be long in the front-rear direction, located forward of the first front end surface of the body portion and configured to cover at least a part of the first front end surface of the body portion, and a second insulating member formed integrally to the first insulating member, the second insulating member includes a first covering portion connected to the first insulating member, shaped to be long in the front-rear direction, located forward of the second front end surface of the body portion and configured to cover at least a part of the second front end surface of the body portion, and a second covering portion shaped to be long in the width direction, located forward of the front end surface of the mounting portion and configured to cover the front end surface of the mounting portion, the first insulating member has a first facing surface facing a side surface on one side of the mounting portion and a first fitting portion is provided on the first facing surface, the first covering portion of the second insulating member has a second facing surface facing a side surface on another side of the mounting portion and a second fitting portion is provided on the second facing surface, a third fitting portion to be fit to the second fitting portion is provided on the side surface on the one side of the mounting portion, a fourth fitting portion to be fit to the second fitting portion is provided on the side surface on the other side of the mounting portion, and a displacement of the insulating member in the front-rear direction is restricted by fitting the first and third fitting portions and fitting the second and fourth fitting portions.

12. The terminal according to claim 11, wherein:

the first fitting portion serves as a first projection projecting toward the side surface on the one side of the mounting portion from the first facing surface, the second fitting portion serves as a second projection projecting toward the side surface on the other side of the mounting portion from the second facing surface, the third fitting portion serves as a first recess open in the side surface on the one side of the mounting portion and to be fit to the first projection, and the fourth fitting portion serves as a fourth recess open in the side surface on the other side of the mounting portion and to be fit to the second projection.

13. The terminal according to claim 11, wherein the first insulating member and the first covering portion of the second insulating member are resiliently displaceable in the width direction.

14. The terminal according to claim 11, wherein:

a first inclined surface thinning a plate thickness toward the front end surface of the mounting portion is provided on a front end part of a plate surface of the mounting portion, a first groove portion long in the width direction is provided to be open in a rear surface of the second covering portion, and an inner surface of the first groove portion is in surface contact with the front end surface and the first inclined surface of the mounting portion.

15. The terminal according to claim 1, wherein:

the mounting portion includes a first mounting portion projecting forward from an end part on one side of the front end surface of the body portion and a second mounting portion projecting forward from an end part on another side of the front end surface of the body portion, the insulating member includes a second covering portion provided from the first mounting portion to the second mounting portion and configured to cover a front end surface of the first mounting portion, a front end surface of the second mounting portion and the front end surface of the body portion, and a second projecting portion projecting toward a gap between the first and second mounting portions from a rear surface of the second covering portion, a first fitting portion is provided on one side surface and a second fitting portion is provided on another side surface, out of both side surfaces in the width direction of the second projecting portion, a third fitting portion to be fit to the first fitting portion is provided on a surface of the first mounting portion facing the one side surface of the second projecting portion, a fourth fitting portion to be fit to the second fitting portion is provided on a surface of the second mounting portion facing the other side surface of the second projecting portion, and a displacement of the insulating member in the front-rear direction is restricted by fitting the first fitting portion to the third fitting portion and fitting the second fitting portion to the fourth fitting portion.

* * * * *